US011820099B2

(12) United States Patent
Hanauer et al.

(10) Patent No.: US 11,820,099 B2
(45) Date of Patent: Nov. 21, 2023

(54) CORRUGATED CARDBOARD PLANT

(71) Applicant: BHS Corrugated Maschinen-und Anlagenbau GmbH, Weiherhammer (DE)

(72) Inventors: Tobias Hanauer, Weiherhammer (DE); Maximilian Mark, Tirschenreuth (DE); Michael Bauernfeind, Schwarzenbach (DE); Karl Ruhland, Pfreimd (DE)

(73) Assignee: BHS CORRUGATED MASCHINEN-UND ANLAGENBAU GMBH, Weiherhammer (DE)

( * ) Notice: Subject to any disclaimer, the term of this patent is extended or adjusted under 35 U.S.C. 154(b) by 27 days.

(21) Appl. No.: 17/052,901

(22) PCT Filed: May 10, 2019

(86) PCT No.: PCT/EP2019/062070
§ 371 (c)(1),
(2) Date: Nov. 4, 2020

(87) PCT Pub. No.: WO2019/219539
PCT Pub. Date: Nov. 21, 2019

(65) Prior Publication Data

US 2021/0237389 A1 Aug. 5, 2021

(30) Foreign Application Priority Data

May 15, 2018 (DE) ..... 10 2018 207 446.1

(51) Int. Cl.
*B31F 1/28* (2006.01)
*B65H 19/18* (2006.01)

(52) U.S. Cl.
CPC ..... *B31F 1/2813* (2013.01); *B31F 1/2822* (2013.01); *B65H 19/1836* (2013.01)

(58) Field of Classification Search
None
See application file for complete search history.

(56) References Cited

U.S. PATENT DOCUMENTS 9,884,497 B2 2/2018 Mark et al.
10,392,215 B2 8/2019 Mark et al.
(Continued)

FOREIGN PATENT DOCUMENTS

DE 3816223 A1 11/1989
DE 102015218321 A1 3/2017
DE 102015218333 A1 3/2017

*Primary Examiner* — Barbara J Musser
(74) *Attorney, Agent, or Firm* — McGlew and Tuttle, P.C.

(57) ABSTRACT

A corrugated cardboard plant has a corrugated cardboard production assembly having at least one device for producing at least one corrugated cardboard web which is laminated on one side, and a connecting device for generating a corrugated cardboard web which his laminated on both sides and which comprises the at least one corrugated cardboard web which is laminated on one side. The corrugated cardboard plant furthermore has a printed web/lamination web production assembly which has a printing device for printing a printed web, a printed web storage device, and a lamination web unwinding device for unwinding a lamination web. The corrugated cardboard plant moreover has a coupling/uncoupling assembly having a coupling device for coupling the printing device to the corrugated cardboard production assembly while using the printed web as the lamination web in the corrugated cardboard production assembly, and/or an uncoupling device for uncoupling the printing device from the corrugated cardboard production assembly while using the lamination web in the corrugated cardboard production assembly.

23 Claims, 28 Drawing Sheets

(56) References Cited

U.S. PATENT DOCUMENTS

| | | | | |
|---|---|---|---|---|
| 2006/0130961 | A1* | 6/2006 | Byrne | B65H 19/286<br>156/159 |
| 2017/0087900 | A1* | 3/2017 | Mark | B31F 1/2822 |
| 2017/0088380 | A1* | 3/2017 | Mark | B65H 19/1873 |

* cited by examiner

CORRUGATED CARDBOARD PLANT

CROSS-REFERENCES TO RELATED APPLICATIONS

This application claims the priority of German Patent Application, Serial No. 10 2018 207 446.1, filed May 15, 2018, the content of which is incorporated herein by reference in its entirety as if fully set forth herein.

FIELD OF THE INVENTION

The invention relates to a corrugated cardboard plant for producing corrugated cardboard. The invention is furthermore directed toward a coupling/uncoupling assembly for a corrugated cardboard plant. The invention is moreover directed toward a method for producing corrugated cardboard.

BACKGROUND OF THE INVENTION

Corrugated cardboard plants on account of obvious prior use are generally known from the prior art. The prior art also discloses corrugated cardboard plants having printing devices for printing a lamination web of a corrugated cardboard web. It is often disadvantageous in these known corrugated cardboard plants that the latter are extremely inflexible. Long retooling times are often required for processing different orders in the corrugated cardboard plant.

SUMMARY OF THE INVENTION

The invention is based on an object of overcoming the disadvantages of the prior art. A corrugated cardboard plant which is extremely flexible is in particular to be provided. A corresponding coupling/uncoupling assembly and a corresponding method for producing corrugated cardboard are likewise to be provided.

This object is achieved by a corrugated cardboard plant for producing corrugated cardboard, having a corrugated cardboard production assembly comprising at least one device for producing at least one corrugated cardboard web which is laminated on one side; and a connecting device for generating a corrugated cardboard web which is laminated on both sides and which comprises the at least one corrugated cardboard web which is laminated on one side; having a printed web/lamination web production assembly comprising a printing device for printing a printed web; a printed web storage device for storing the printed web; and a lamination web unwinding device for unwinding a lamination web; and having a coupling/uncoupling assembly comprising a coupling device for coupling the printing device to the corrugated cardboard production assembly while using the printed web as a lamination web in the corrugated cardboard production assembly; and/or an uncoupling device for uncoupling the printing device from the corrugated cardboard production assembly while using the lamination web in the corrugated cardboard production assembly.

This object is further achieved by a coupling/uncoupling assembly for a corrugated cardboard plant according to the invention comprising a coupling device for coupling a printing device to a corrugated cardboard production assembly while using a printed web as a lamination web in the corrugated cardboard production assembly; and/or an uncoupling device for uncoupling the printing device from the corrugated cardboard production assembly while using a lamination web in the corrugated cardboard production assembly.

This object is further achieved by a method for producing corrugated cardboard, comprising the following steps: producing corrugated cardboard in a corrugated cardboard production assembly which comprises at least one device for producing at least one corrugated cardboard web which is laminated on one side; and a connecting device for generating a corrugated cardboard web which is laminated on both sides and which comprises the at least one corrugated cardboard web which is laminated on one side; producing a printed web and/or a lamination web in a printed web/lamination web production assembly which comprises a printing device for printing the printed web; a printed web storage device for storing the printed web; and a lamination web unwinding device for unwinding the lamination web; and coupling the printing device to the corrugated cardboard production assembly while using the printed web as lamination web in the corrugated cardboard production assembly; and/or uncoupling the printing device from the corrugated cardboard production assembly while using the lamination web in the corrugated cardboard production assembly.

The core of the invention lies in a coupling/uncoupling assembly which is capable of coupling, in particular in a functional manner, the printing device to the corrugated cardboard production assembly such that the printed web, which may be printed by means of the printing device, is able to be used, or is used, respectively, as a lamination web in the corrugated cardboard production assembly, and/or of uncoupling, in particular in a functional manner, said printing device from the corrugated cardboard production assembly such that the printed web is not utilized as a lamination web in the corrugated cardboard production assembly and the lamination web which is unwound from the lamination web unwinding device is favorably able to be utilized in the corrugated cardboard production assembly. The coupling/uncoupling assembly enables a changeover between the printed web and the lamination web, in particular from the previous web to the new web, in the corrugated cardboard production assembly.

A separate production, and in particular also a separate handling, of the printed web and the lamination web in the uncoupled state of the printing device and the corrugated cardboard production assembly is possible in the printed web/lamination web production assembly. The printed web or the lamination web is/are thus producible in a separate or a conjoint manner.

The printed web/lamination web production assembly in the coupled state of the printing device and the corrugated cardboard production assembly produces in particular only the printed web.

When the printing device is coupled to the corrugated cardboard production assembly, the coupling device preferably connects the printed web and the lamination web to one another.

When the printing device is uncoupled from the corrugated cardboard production device, the uncoupling device preferably ensures a connection between the lamination web and the printed web and between a stored web, which is stored in the printed web storage device, and the printed web.

The lamination web and the printed web are able to be joined, in particular spliced, to one another in particular in an adhesive manner, preferably while using at least one adhesive tape.

The stored web and the printed web are able to be joined, in particular spliced, to one another in particular in an adhesive manner, preferably while using at least one adhesive tape.

When at least one adhesive tape is attached to a web, or when the latter is fixedly connected to a further web, respectively, it is expedient for the web, preferably at the end side, to be locally established in particular in relation to an adjacent holding element such as a roller. This takes place by means of a vacuum, for example, or by clamping, respectively.

The storage device is preferably embodied as a winding device.

The at least one device for producing at least one corrugated cardboard web which is laminated on one side preferably has at least one corrugating installation for corrugating at least one material web to be corrugated, while forming a corrugated web.

It is advantageous for the at least one device for producing at least one corrugated cardboard web which is laminated on one side to have at least one glue application installation for gluing the at least one corrugated web.

It is expedient for the at least one device for producing at least one corrugated cardboard web which is laminated on one side to comprise at least one contact pressure installation for pressing at least one cover web against the at least one corrugated web provided with glue.

The at least one corrugated cardboard web which is laminated on one side preferably comprises in each case one corrugated web and one cover web. It is expedient for the at least one cover web unwinding device to unwind the at least one cover web. The cover web unwinding device is favorably embodied as a cover web splicing device for unwinding a continuous cover web. It is expedient for at least one corrugated web/material web unwinding device to unwind the at least one corrugated web/material web. The corrugated web/material web unwinding device is favorably embodied as a corrugated web/material web splicing device for unwinding a continuous corrugated web/material web.

It is expedient for the printed web/lamination web production assembly to have at least one conveying installation for conveying the printed web or the lamination web, respectively.

The printed web/lamination web production assembly favorably has a pre-coating installation for pre-coating the printed web to be printed.

It is advantageous for the printed web/lamination web production assembly to comprise a corona pre-treatment installation for pre-treating the printed web to be printed.

The printed web/lamination web production assembly preferably has a lacquering device for lacquering the printed web which has been printed, or the at least one printed region of said printed web, respectively.

It is expedient for the printed web/lamination web production assembly to comprise at least one drying installation for drying the printed web. Drying of the pre-coating of the at least one imprint and/or of the lacquer favorably takes place.

The printing device is advantageously a digital printing device, in particular an ink jet printing device. Said printing device can comprise a plurality of printing installations. Other known printing devices can be alternatively used. The printing device is in particular capable of printing at least one letter, a digit, another sign, a graphic design and/or a photograph on the printed web. Printing color or ink, respectively, is favorably used to this end. The printed web preferably is, or remains, respectively, a smooth non-corrugated web.

The lamination web unwinding device is preferably arranged outside of, or at a distance from, respectively, the corrugated cardboard production assembly.

The lamination web is able to be transferred from the printed web/lamination web production assembly to the corrugated cardboard production assembly by means of the transfer assembly, for example. Alternatively, the printed web as the lamination web is able to be transferred from the printed web/lamination web production assembly to the corrugated cardboard production assembly by means of the transfer assembly.

The connecting device while using the at least one corrugated cardboard web, which is laminated on one side, and the lamination web/printed web, and while connecting both, generates the corrugated cardboard web which is laminated on both sides. Said connecting device is favorably configured as a heating and drawing device, or as a heating/contact pressure device. It is expedient for said connecting device to comprise a heating table and at least one contact pressure belt, while forming a contact pressure gap between the at least one contact pressure belt and the heating table.

The finished corrugated cardboard favorably has three plies. Alternatively, said finished corrugated cardboard has more than three plies, for example five or seven plies. The lamination web/printed web forms an outer ply. The finished corrugated cardboard can be printed or not printed on the outside.

The terms "upstream", "downstream", "disposed downstream", "disposed upstream" or the like used here refer in particular to the web which is in each case conveyed or transported.

The coupling/uncoupling assembly which operates in an at least partially, favorably at least largely, favorably completely, automated manner, is particularly operator-friendly or user-friendly, respectively. Said coupling/uncoupling assembly operates extremely efficiently or economically, respectively. The coupling device and/or the uncoupling device operate/operates in an at least partially, favorably at least largely, favorably completely, automated manner.

The corrugated cardboard plant configured such that the coupling device in case of transported printed web and/or lamination web is capable of coupling the printing device to the corrugated cardboard production assembly while using the printed web as lamination web in the corrugated cardboard production assembly, is particularly economical. Coupling the printing device and the corrugated cardboard production assembly to one another is in particular possible without stopping the corrugated cardboard plant, or the printed web/lamination web production assembly and/or the corrugated cardboard production assembly, respectively. It is expedient for the corrugated cardboard production assembly and the printed web/lamination web production assembly in functional terms to be at least temporarily mutually independent. Said corrugated cardboard production assembly and said printed web/lamination web production assembly when coupling, or for coupling, respectively, are preferably capable of operating or producing, respectively, in a mutually independent manner. The corrugated cardboard production assembly in this instance possibly produces a corrugated cardboard web which is laminated on both sides, while the printed web/lamination web production assembly produces a printed web which is printed, for example, and/or unwinds a lamination web. Preparatory tooling in this instance is preferably possible when the corrugated cardboard production assembly and/or the printed web/lamination web production assembly operates or produces, respectively.

The corrugated cardboard plant configured such that the uncoupling device in case of transported printed web and/or lamination web is capable of uncoupling the printing device from the corrugated cardboard production assembly while using the lamination web in the corrugated cardboard production assembly, is extremely economical. Uncoupling the printing device and the corrugated cardboard production assembly from one another is in particular possible without stopping the corrugated cardboard plant, or the printed web/lamination web production assembly and/or the corrugated cardboard production assembly, respectively. It is expedient for the corrugated cardboard production assembly and the printed web/lamination web production assembly in functional terms to be at least temporarily mutually independent. Said corrugated cardboard production assembly and said printed web/lamination web production assembly when uncoupling, or for uncoupling, respectively, are preferably capable of operating or producing, respectively, in a mutually independent manner. The corrugated cardboard production assembly in this instance possibly produces a corrugated cardboard web which is laminated on both sides, while the printed web/lamination web production assembly produces a printed web which is printed, for example, and/or unwinds a lamination web. Preparatory tooling in this instance is preferably possible when the corrugated cardboard production assembly and/or the printed web/lamination web production assembly operates or produces, respectively.

The coupling/uncoupling assembly according to the invention is disposed between the lamination web unwinding device and the connecting device, thus the corrugated cardboard production assembly.

The corrugated cardboard plant according to dependent claim configured such that the coupling/uncoupling assembly comprises a lamination web guide for guiding the lamination web and/or a printed web guide for guiding the printed web, wherein the printed web guide is separate from said lamination web guide, in functional terms is extremely reliable. The coupling/uncoupling assembly is in particular capable of conveying the currently conveyed web/webs in a malfunction-free manner. Any mutual impediment between said webs therein is avoidable, for example.

The printed web and the lamination web in case of uncoupled printing device and corrugated cardboard production assembly are in particular guided separately in the coupling/uncoupling assembly.

The at least one activatable lamination web/printed web converging installation for in regions converging the lamination web (40) and the printed web, is able to be used for coupling the printing device and the corrugated cardboard production assembly and/or for uncoupling said printing device and said corrugated cardboard production assembly. For example, said at least one lamination web/printed web converging installation is capable of in regions converging the lamination web and the printed web while forming a direct or indirect, in particular linear, area of contact for coupling the printing device and the corrugated cardboard production assembly. For example, said lamination web/printed web converging installation is capable of in regions converging the lamination web and the storage web with the printed web, while forming a direct or indirect, in particular linear, area of contact for uncoupling the printing device and the corrugated cardboard production assembly. It is expedient for the lamination/printed web converging installation to comprise at least one displacing unit such as a hydraulic unit, a pneumatic unit, an electric drive, or the like.

The at least one pair of converging elements which for in regions converging the lamination web and the printed web are displaceable relative to one another while forming a convergence gap, when converging, favorably engages on the lamination web and the printed web, or the wound web, respectively, on sides of said lamination web and said printed web, or said wound web, respectively, that face away from one another. The converging elements are identical in terms of construction, for example, or are dissimilar.

At least one converging element is preferably embodied as a roller, a roll, or a rotationally fixed element such as a platen, a block, or the like. It is expedient for the at least one pair of converging elements to be displaceable in a uniform manner Non-uniform displacing alternatively takes place. For example, one of the converging elements is locationally fixed. The displacing preferably takes place by way of the at least one displacing unit. It is expedient for the lamination web/printed web converging installation to be capable of locationally establishing the lamination web and/or the printed web/wound web for preparing a fixed connection between said lamination web and/or said printed web/wound web, or for uncoupling the printing device from the corrugated cardboard production assembly, respectively. For example, a first converging element is capable of locationally establishing the lamination web. For example, a second converging element is capable of locationally establishing the printed web/wound web. The respective web is preferably able to be established in a clamped manner and/or by means of a vacuum on the respective converging element, or in relation to the latter, respectively. It is expedient for the respective converging element for holding the respective web to be embodied as a vacuum roller, and/or for at least one clamping means to be assigned to said converging element.

The at least one adhesive tape application device for applying at least one adhesive tape to the printed web and/or the lamination web for fixedly connecting the printed web and the lamination web to one another, said adhesive tape application device being assigned to the printed web and/or the lamination web, favorably comprises at least one displaceable or activatable, respectively, adhesive tape application element for holding at least one adhesive strip and transferring the latter between an adhesive tape receiving position and an adhesive tape transferring position. The at least one adhesive tape application element is preferably embodied as a pivotable or rotatable, respectively, adhesive tape transfer roller. It is expedient for the at least one adhesive tape application device to have at least one counter-element for interacting with the at least one adhesive tape application element in the adhesive tape transferring position of the latter.

The at least one adhesive tape application device for coupling the printing device and the corrugated cardboard production assembly favorably applies at least one adhesive tape to the lamination web in order to be connected to the printed web. The at least one adhesive tape application device for uncoupling the printing device and the corrugated cardboard production assembly favorably applies at least one adhesive tape to the printed web in order to be connected to the storage web. Alternatively, the at least one adhesive tape application device for uncoupling the printing device and the corrugated cardboard production assembly favorably applies at least one adhesive tape to the storage web in order to be connected to the printed web.

The at least one lamination web separating device for, in particular completely, separating the lamination web, wherein the at least one lamination web separating device in conveying direction of the lamination web is preferably disposed upstream of a lamination web printed web converging installation, wherein the at least one lamination web separating device in conveying direction of the lamination web is preferably disposed downstream of an adhesive tape application device, favorably comprises at least one displaceable lamination web separating element and favorably also a corresponding lamination web counter-separating element for interacting with the at least one lamination web separating element when separating the lamination web. This design embodiment leads to a particularly efficient coupling/uncoupling assembly. The at least one lamination web separating device is preferably active when, or for, respectively, coupling the printing device and the corrugated cardboard production assembly.

The at least one printing web separating device for, in particular completely, separating the printed web, wherein a printed web separating device in conveying direction of the printed web is preferably disposed downstream of a lamination web printed web converging installation, wherein the at least one printed web separating device in conveying direction of the printed web is preferably disposed downstream of an adhesive tape application device, favorably comprises at least one displaceable printed web separating element and favorably also a corresponding printed web counter-element for interacting with the at least one printed web separating element when separating the printed web. This design embodiment leads to a particularly efficient coupling/uncoupling assembly. The at least one printed web separating device is favorably active when, or for, respectively, coupling and/or uncoupling the printing device and the corrugated cardboard production assembly.

The explanations pertaining to dependent claims 3 and 4 apply in a substantially analogous manner to dependent claims 18 and 19, respectively.

Dependent claims 2 to 15 and the explanations pertaining thereto preferably also relate to advantageous refinements of main claims 16 and 17, respectively.

Two preferred embodiments of the invention will be described in an exemplary manner hereunder with reference to the appended drawing.

DESCRIPTION OF THE PREFERRED EMBODIMENTS

Figure 1:
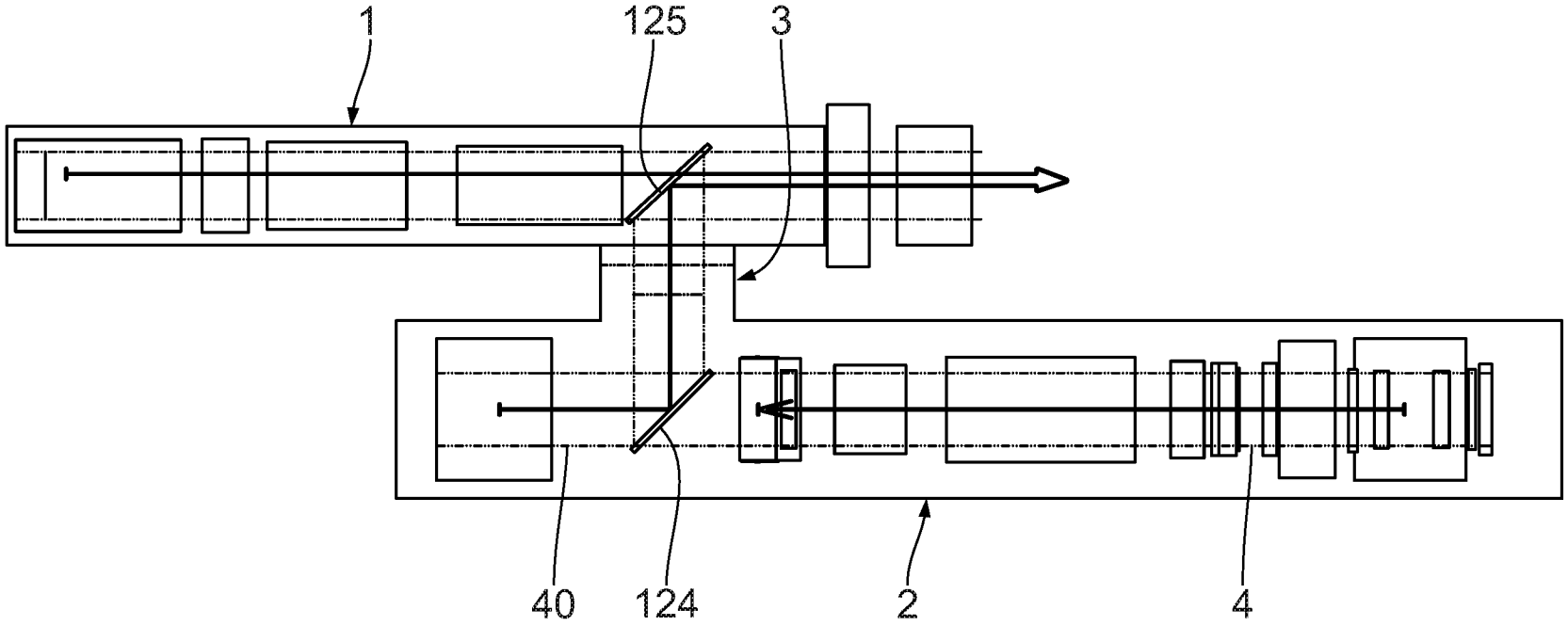
FIG. 1 shows a schematic plan view of part of a corrugated cardboard plant according to the invention.
Figure 2:
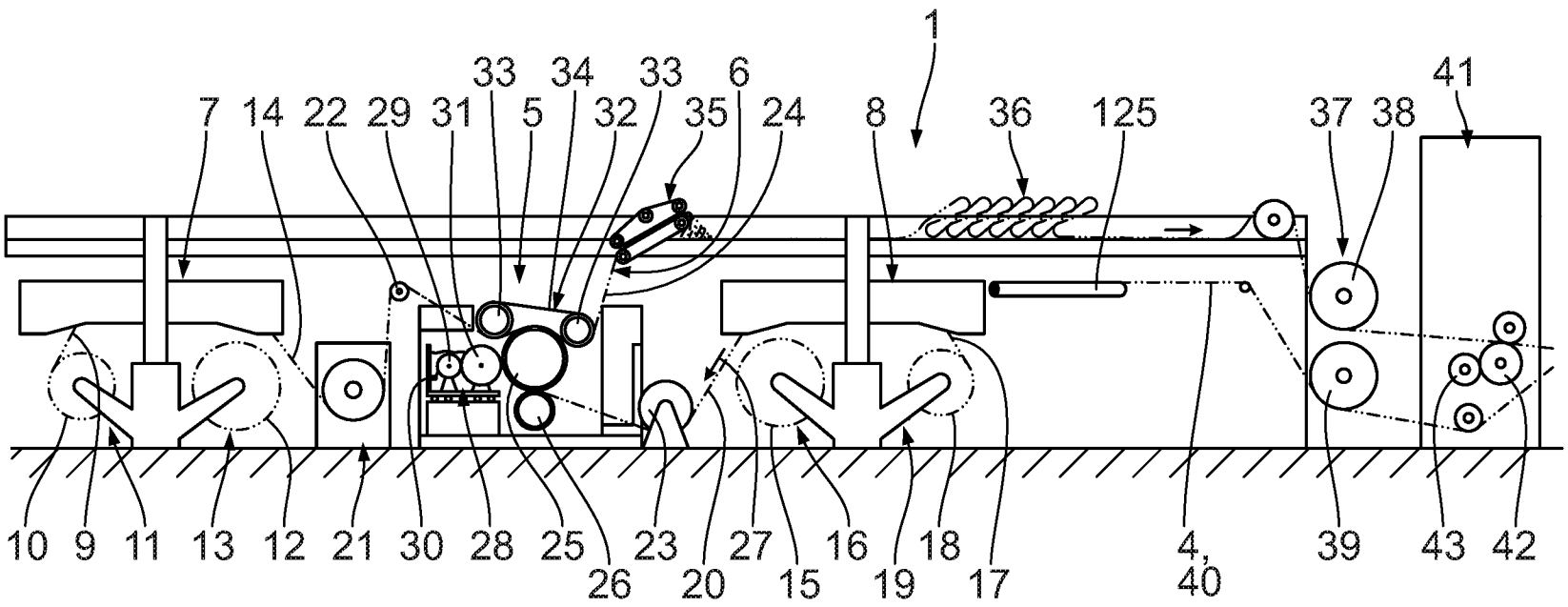
FIG. 2 shows a partial lateral view of a corrugated cardboard production assembly of the corrugated cardboard plant shown in FIG. 1.
Figure 3:
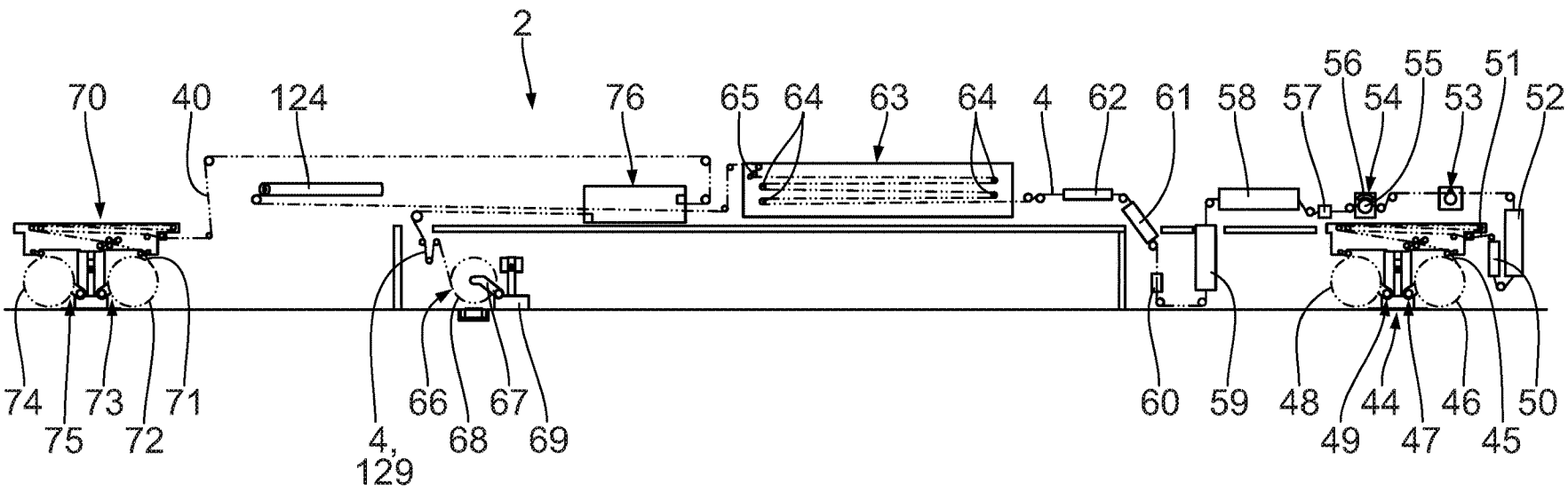
FIG. 3 shows a lateral view of a printed web/lamination web production assembly of the corrugated cardboard plant visualized in FIG. 1.
Figure 4:
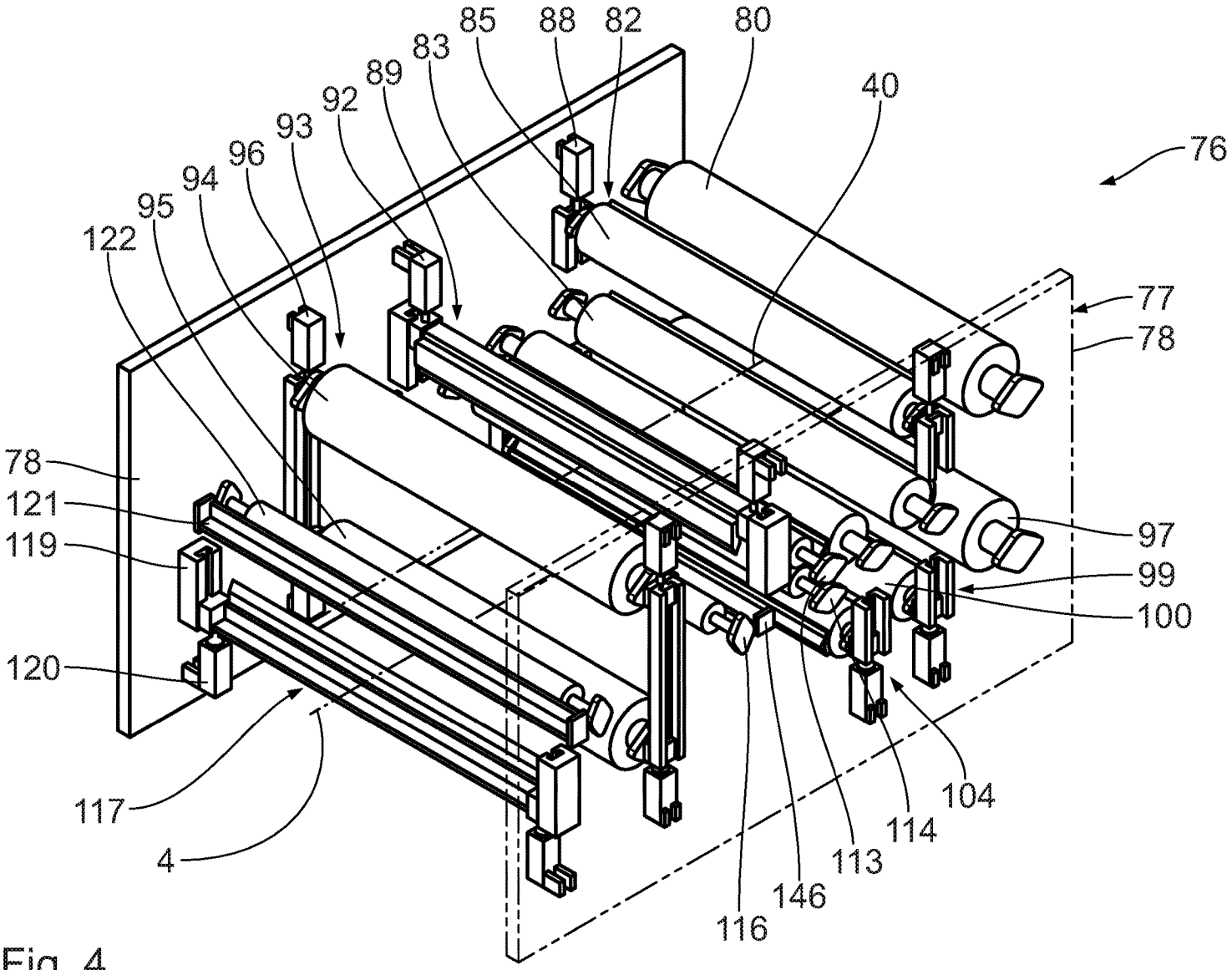
FIG. 4 shows a perspective view of a coupling/uncoupling assembly according to the invention of the corrugated cardboard plant shown in FIG. 1.

Initially making reference to FIGS. 1 to 3, a corrugated cardboard plant (not illustrated in its entirety) comprises a corrugated cardboard production assembly 1 (not illustrated in its entirety) and a printed web/lamination web production assembly 2 as well as a lamination web transfer assembly 3 by way of which the printed web/lamination web production assembly 2 is connected, in particular laterally, to the corrugated cardboard production assembly 1. An, in particular continuous three-ply, corrugated cardboard web is able to be produced in the corrugated cardboard production assembly 1, while an, in particular continuous, lamination web 40, and/or a printed web 4, which is optionally printed, are/is able to be produced in the printed web/lamination web production assembly 2.

The corrugated cardboard production assembly 1 which is in particular illustrated in FIGS. 1, 2 comprises a device 5 for producing a continuous corrugated cardboard web 6 which is laminated on one side.

Disposed upstream of the device 5 for producing a continuous corrugated cardboard web 6 which is laminated on one side are a cover web splicing device 7 and a material web splicing device 8.

The cover web splicing device 7 for unwinding a finite first cover web 9 from a first cover web roll 10 comprises a first unwinding unit 11, and for unwinding a finite second cover web from a second cover web roll 12 comprises a second unwinding unit 13. The finite first cover web 9 and the finite second cover web for providing a continuous cover web 14 are connected to one another by means of a connecting and cutting unit of the cover web splicing device 7, said connecting and cutting unit not being illustrated.

The material web splicing device 8 is embodied so as to correspond to the cover web splicing device 7. The latter for unwinding a finite first material web from a first material web roll 15 comprises a third unwinding unit 16, and for unwinding a finite second material web 17 from a second material web roll 18 comprises a fourth unwinding unit 19. The finite first material web and second material web 17 for providing a continuous material web 20 are connected to one another by means of a connecting and cutting unit (not illustrated) of the material web splicing device 8.

The continuous cover web 14 by way of a heating assembly 21 and a deflection roller 22 is fed to the device 5 in order to produce a continuous corrugated cardboard web 6 which is laminated on one side, while the continuous material web 20 by way of a further deflection roller 23 is fed to the device 5 in order to produce a continuous corrugated cardboard web 6 which is laminated on one side.

The device 5 for producing a continuous corrugated cardboard web 6 which is laminated on one side, for generating from the continuous material web 20 a continuous corrugated web 24 which has a corrugation, comprises a rotatably mounted first corrugated roller 25 and a rotatably mounted second corrugated roller 26. The corrugated rollers 25, 26 are disposed in pairs and configure a corrugating gap for passing through and corrugating the continuous material web 20. Said corrugating rollers 25, 26 conjointly form a corrugating installation. Rotation axes of the corrugating rollers 25, 26 run so as to be horizontal and perpendicular to a conveying direction 27 of the continuous material web 20.

For connecting the continuous material web 24 to the continuous cover web 14 so as to form the continuous corrugated cardboard web 6 which is laminated on one side the device 5 for producing a continuous corrugated cardboard web 6 which is laminated on one side has a glue application installation 28 which comprises a glue metering roller 29, a glue container 30, and a glue application roller 31. The glue application roller 31 conjointly with the first corrugated roller 25 configures a gluing gap for passing through and gluing the continuous corrugated web 24. The glue, which is situated in the glue container 30, by way of the glue application roller 31 is applied to tips of the corrugation of the continuous corrugated web 24 in the gluing gap. The glue metering roller 29 bears on the glue application roller 31 and serves for configuring a uniform glue layer on the glue application roller 31.

The continuous cover web 14, conjointly with the continuous corrugated web 24 which is provided with glue from the glue container 30, is joined in the device 5 so as to produce a continuous corrugated cardboard web 6 which is laminated on one side.

In order for the continuous cover web 14 to be pressed against the continuous corrugated web 24 which is provided with glue and which in turn in regions bears on the first corrugated roller 25, the device 5 for producing a continuous corrugated cardboard web 6 which is laminated on one side has a contact pressure module 32. The contact pressure module 32 is favorably embodied as a contact pressure belt module. Said contact pressure module 32 is disposed above the first corrugated roller 25. The contact pressure module 32 has two deflection rollers 33 and a continuous contact pressure belt 34 which is guided about the two deflection rollers 33.

The first corrugated roller 25 in regions engages from below in a space which is present between the two deflection rollers 33, on account of which the contact pressure belt 34 is deflected by the first deflection rollers 25. The contact pressure belt 34 presses against the continuous cover web 14 which in turn is pressed against the continuous corrugated web 24 which is provided with glue and bears on the first corrugated roller 25.

The continuous corrugated cardboard web 6, which is laminated on one side, by way of an elevated transport installation 35 of the corrugated cardboard production assembly 1 is fed to a storage device 36 for temporary storing and buffering, said continuous corrugated cardboard web 6 therein configuring loops.

The corrugated cardboard production assembly 1, in terms of the conveying direction of the continuous corrugated cardboard web 6 which is laminated on one side, downstream of the storage device 36 and of the material web splicing device 8 has a pre-heating assembly 37 which comprises two pre-heating rollers 38, 39 which are disposed on top of one another. The continuous corrugated cardboard web 6, which is laminated on one side, and the, in particular continuous, lamination web 40 are fed to the pre-heating assembly 37, said corrugated cardboard web 6 and said lamination web 40 both partly wrapping the respective pre-heating roller 38 or 39, respectively.

The corrugated cardboard production assembly 1, in terms of the conveying direction of the continuous corrugated cardboard web 6 which is laminated on one side, downstream of the pre-heating assembly 37 has a glue unit 41 having a gluing roller 42 which is partially immersed in a glue bath. A glue metering roller 43 of the glue unit 41 bears on the gluing roller 42 so as to configure a uniform glue layer on the gluing roller 42. The continuous corrugated cardboard web 6 which is laminated on one side, by way of the corrugated web 24 thereof is in contact with the gluing roller 42 such that the corrugation of the corrugated web 24 is provided with glue from the glue bath.

The corrugated cardboard production assembly 1, in terms of the conveying direction of the continuous corrugated cardboard web 6 which is laminated on one side, downstream of the gluing unit 41 has a heating and contact pressure device (not illustrated) which comprises a horizontally running heated table. A continuous contact pressure belt which is guided about guide rollers is disposed so as to be adjacent to the heating table. A contact pressure gap is configured between the contact pressure belt and the heating table, the continuous corrugated cardboard web 6, which is laminated on one side, and the continuous lamination web 40, or the printed web 4, respectively, being guided through said contact pressure gap while forming the continuous corrugated cardboard web which is laminated on two sides.

The corrugated cardboard production assembly 1, in terms of a conveying direction of the continuous corrugated cardboard web which is laminated on two sides, downstream of the heating and contact pressure device favorably has a longitudinal cutting/corrugating device (not illustrated) for longitudinally cutting and corrugating the continuous corrugated cardboard web which is laminated on two sides.

The corrugated cardboard production assembly 1, in terms of the conveying direction of the corrugated cardboard web which is laminated on two sides, downstream of the longitudinal cutting/corrugating device preferably has a transverse cutting device (not illustrated) for transversely cutting corrugated cardboard sub-webs (not illustrated) which by the longitudinal cutting/corrugating device have been generated from the continuous corrugated cardboard web which is laminated on two sides.

A turnout (not illustrated) of the corrugated cardboard production assembly 1 is preferably disposed downstream of the longitudinal cutting/corrugating device so as to convey the corrugated cardboard sub-webs in different planes.

Transverse cutting devices (not illustrated) of the corrugated cardboard production assembly 1 for transversely cutting the corrugated cardboard sub-webs so as to form corrugated cardboard sheets are favorably disposed downstream of the turnout. The corrugated cardboard sheets are preferably stacked on top of one another in stacking devices (not illustrated) of the corrugated cardboard production assembly 1.

The printed web/lamination web production assembly 2 shown in particular in FIGS. 1, 3 comprises a printed web splicing device 44 which in turn for unwinding a finite first printed web 45 from a first printed web roll 46 comprises a fifth unwinding unit 47, and for unwinding a finite second printed web from a second printed web roll 48 comprises a sixth unwinding unit 49. The finite first printed web 45 and second printed web for providing the continuous printed web 4 are connected to one another by means of a connecting and cutting unit (not illustrated) of the printed web splicing device 44.

The printed web/lamination web production assembly 2, in terms of a conveying direction 98 of the continuous printed web 4 in the printed web/lamination production assembly 2, downstream of the printed web splicing device 44 has a pre-coating application device 50 which is assigned to the continuous printed web 4 and applies a planar pre-coating to an external side 51 of the continuous printed web 4. The planar pre-coating covers the continuous printed web 4, in particular across the full area, on the external side 51 thereof which in the finished corrugated cardboard web which is laminated on both sides likewise forms an external side.

The printed web/lamination web production assembly 2, in terms of the conveying direction 98 of the continuous printed web 4 in the printed web/lamination web production assembly 2, downstream of the pre-coating application device 50 has a pre-coating drying device 52 which is assigned to the continuous printed web 4 and dries the continuous printed web 4 which on the external side is provided with the pre-coating, or dries the pre-coating, respectively.

The printed web/lamination web production assembly 2, in terms of the conveying direction 98 of the continuous printed web 4 in the printed web/lamination web assembly 2, downstream of the pre-coating drying device 52 has a drawing unit 53 which is assigned to the continuous printed web 4 and conveys the continuous printed web 4 in the printed web/lamination web production assembly 2, or draws said continuous printed web 4 away from the printed web splicing device 44.

The printed web/lamination web production assembly 2, in terms of the conveying direction 98 of the continuous printed web 4 in the printed web/lamination web production assembly 2, downstream of the drawing unit 53 has a corona pre-treatment device 54 which is assigned to the continuous printed web 4. The corona pre-treatment device 54 comprises a corona support roller 55 and at least one electrode 56 which is disposed so as to be adjacent to said corona support roller 55. The continuous printed web 4 is guided about the corona support roller 55. The continuous printed web 4 herein runs through a corona pre-treatment gap which is formed by the corona support roller 55 and the at least one electrode 56. The external side 51 of the continuous printed web 4 in the corona pre-treatment gap is exposed to an electric corona discharge, this leading to the surface of said external side 51 being oxidized. This takes place in particular in case of coated continuous printed web 4. This results in higher dot gains when ink is applied, or when printing takes place, respectively. The adhesion of a printing ink on the continuous printed web 4 is thus improved.

The printed web/lamination web production assembly 2, in terms of the conveying direction 98 of the continuous printed web 4 in the printed web/lamination web production assembly 2, downstream of the corona pre-treatment device 54 has a cleaning device 57 which is assigned to the continuous printed web 4 and cleans the continuous printed web 4 at least on the external side.

The printed web/lamination web production assembly 2, in terms of the conveying direction 98 of the continuous printed web 4 in the printed web/lamination web production assembly 2, downstream of the cleaning device 57 has an inkjet printing device 58 which is assigned to the continuous printed web 4 and prints at least one imprint on the external side of the continuous printed web 4, or on the dried pre-coating, respectively. The pre-coating is thus situated between the at least one imprint and the continuous printed web 4. The at least one imprint is favorably a water-based ink imprint.

The printed web/lamination web production assembly 2, in terms of the conveying direction 98 of the continuous printed web 4 in the printed web/lamination web production assembly 2, downstream of the inkjet printing device 58 has an inkjet printing drying device 59 which is assigned to the continuous printed web 4 and dries the continuous printed web 4 which has been printed, or the at least one imprint of the latter, respectively.

The printed web/lamination web production assembly 2, in terms of the conveying direction 98 of the continuous printed web 4 in the printed web/lamination web production assembly 2, downstream of the inkjet printing drying device 59 has a lacquer unit 60 which, for applying across the full area at least one transparent cover lacquer layer to the external side of the continuous printed web 4, is assigned to the continuous printed web 4. The at least one imprint is thus situated between the at least one cover lacquer layer and the pre-coating. The at least one cover lacquer layer covers the at least one imprint across the full area and bears directly on said imprint. Said at least one cover lacquer layer is favorably formed by a matt lacquer which is water-based and is also referred to as water lacquer.

The printed web/lamination web production assembly 2, in terms of the conveying direction 98 of the continuous printed web 4 in the printed web/lamination web production assembly 2, downstream of the lacquer unit 60 has a lacquer drying device 61 which is assigned to the continuous printed web 4 and dries the lacquered continuous printed web 4, or the at least one cover lacquer layer of the latter, respectively.

The printed web/lamination web production assembly 2, in terms of the conveying direction 98 of the continuous printed web 4 in the printed web/lamination web production assembly 2, downstream of the lacquer drying device 61 has a remoistening device 62 which is assigned to the continuous printed web 4 and moisturizes the continuous printed web 4 at least on the external side, or the side which is to be glued to the continuous corrugated cardboard web 6 which is laminated on one side, respectively.

The printed web/lamination web production assembly 2 moreover has a printed web buffer device 63 for buffering the, optionally printed, continuous printed web 4. The printed web buffer device 63, in terms of the conveying direction 98 of the continuous printed web 4 in the printed web/lamination web production assembly 2, is disposed downstream of the remoistening device 62. The printed web buffer device 63 is embodied as a dynamic printed web buffer device.

The continuous printed web 4 in the printed web buffer device 63 is guided in a substantially meandering manner about a plurality of deflection rollers 64. At least one of the deflection rollers 64 is displaceable in a manner perpendicular to the rotation axis of said deflection rollers 64 such that a length of the continuous printed web 4 that is buffered or stored, respectively, in the printed web buffer device 63 is dynamically variable.

A drawing unit 65 which comprises at least one drawing roller for drawing the continuous printed web 4 away from the printed web splicing device 44 in the printed web/lamination web production assembly 2 is disposed so as to be proximal to the exit in the printed web buffer device 63.

A printed web winding device, or storage device 66, respectively, of the printed web/lamination web production assembly 2, in terms of the conveying direction 98 of the continuous printed web 4 in the printed web/lamination web production assembly 2, is disposed downstream of the printed web buffer device 63. The printed web winding device 66 for winding the, optionally printed, continuous printed web 4 comprises a printed web winding role 68 which is rotatably mounted in bearing arms 67. The bearing arms 67 are favorably pivotable about a horizontal pivot axis. The bearing arms 67 are mounted so as to be pivotable on a printed web winding frame 69. The continuous printed web 4 has to run through the printed web storage device 63 in order for said continuous printed web 4 to reach the printed web winding device 66 and thereon to be able to be wound as a wound web or stored web, respectively. Said continuous printed web 4 when required is able to be unwound from the printed web winding device 66 and here is also referred to as a wound web or a stored web, respectively.

The printed web/lamination web production assembly 2 moreover has a lamination web splicing device 70 which for unwinding a finite first lamination web 71 from a first lamination web roll 72 comprises a seventh unwinding unit 73, and for unwinding a finite second lamination web from a second lamination web roll 74 comprises an eighth unwinding unit 75. The finite first lamination web 71 and second lamination web for providing the continuous lamination web 40 are connected to one another by means of a connecting and cutting unit (not illustrated) of the lamination web splicing device 70.

The printed web/lamination web production assembly 2 furthermore has a coupling/uncoupling assembly 76, the construction and operation mode thereof being visualized in detail in FIGS. 4 to 15.

The coupling/uncoupling assembly 76 is disposed between the printed web splicing device 44, or the inkjet printing device 58, respectively, and the printed web winding device 66. Said coupling/uncoupling assembly 76 is furthermore disposed between the lamination web splicing device 70 and the corrugated cardboard production assembly 1, or the connecting device, respectively.

The coupling/uncoupling assembly 76 has a frame 77 which comprises two mutually opposite bearing walls 78 which run in a vertical manner.

A lamination web pilot roller 80 is mounted so as to be rotatable on the bearing walls 78 in a first end region 79 of the frame 77 which faces the printed web splicing device 44, or the inkjet printing device 58, respectively. The lamination web pilot roller 80 extends horizontally and runs so as to be perpendicular to a lamination web conveying direction 81 of the continuous lamination web 40 in the coupling/uncoupling assembly 76. Said lamination web pilot roller 80 extends across the entire width of the continuous lamination web 40. The lamination web pilot roller 80 is assigned to the continuous lamination web 40.

The coupling/uncoupling assembly 76 moreover comprises a first adhesive tape application device 82 which in terms of the lamination web conveying direction 81 is disposed downstream of the lamination web pilot roller 80. The first adhesive tape application device 82 comprises a first adhesive tape roller 83 which is mounted so as to be pivotable or rotatable, respectively, on the bearing walls 78 and by way of a circumferential region supports an adhesion element 84. The first adhesive tape roller 83 extends horizontally and runs so as to be perpendicular to the lamination web conveying direction 81 of the continuous lamination web 40, or to a printed web conveying direction 98 of the continuous printed web 4 in the printed web/lamination web production assembly 2, respectively. Said first adhesive tape roller 83 extends across the entire width of the continuous lamination web 40, or of the continuous printed web 4, respectively.

The first adhesive tape application device 82 furthermore comprises a pivotable adhesive tape counter-roller 85 which is assigned to the first adhesive tape roller 83 and by way of a circumferential region supports a counter-element 86. The adhesive tape counter-roller 85 is disposed above the first adhesive tape roller 83. Said adhesive tape counter-roller 85 extends horizontally and runs so as to be perpendicular to the lamination web conveying direction 81 of the continuous lamination web 40. The adhesive tape counter-roller 85 extends across the entire width of the continuous lamination web 40. Said adhesive tape counter-roller 85 in a vertical guide 87, which is disposed on the bearing walls 78, by means of a lifting device 88 is vertically displaceable between an upper inactive position and a lower active adhesive position, said adhesive tape counter-roller 85 in said lower active adhesive position, conjointly with the first adhesive tape roller 83, configuring an adhesive tape application gap.

The coupling/uncoupling assembly 76 has a lamination web separating device 89 which, in terms of the lamination web conveying direction 81, is disposed downstream of the first adhesive tape application device 82. The lamination web separating device 89 comprises a lamination web separating element 90 which extends horizontally and runs so as to be perpendicular to the lamination web conveying direction 81 of the continuous lamination web 40. The lamination web separating element 90 in the manner of a blade extends across the entire width of the continuous lamination web 40. Said lamination web separating element 90 along a vertical guide 91, which is disposed on the bearing walls 78, by means of a lifting device 92 is vertically displaceable between an upper inactive position and a lower separating position.

The lamination web separating device 89 moreover comprises a lamination web separating counter-element 146 which is disposed so as to be locationally fixed on the bearing walls 78 and extends horizontally and runs so as to be perpendicular to the lamination web conveying direction 81 of the continuous lamination web 40. The lamination web separating counter-element 146 extends across the entire width of the continuous lamination web 40 and supports the continuous lamination web 40 from below when the continuous lamination web 40 is being separated. Said lamination web separating counter-element 146 is in the manner of a platen.

The coupling/uncoupling assembly 76 has a lamination web printed web converging installation 93 which, in terms of the lamination web conveying direction 81, is disposed downstream of the lamination web separating device 89 and has a pair of converging rollers 94, 95. The converging rollers 94, 95 run so as to be mutually parallel and on top of one another. Said converging rollers 94, 95 extend horizontally and perpendicularly to the lamination web conveying direction 81 of the continuous lamination web 40, or to the printed web conveying direction 98 of the continuous printed web 4, respectively. The converging rollers 94, 95 extend across the entire width of the continuous lamination web 40, or of the continuous printed web 4, respectively. Said converging rollers 94, 95 are mounted so as to be vertically displaceable relative to one another and are rotatable on a vertical guide 96 which is disposed on the bearing walls 78. The converging roller 94 is assigned to the continuous lamination web 40, while the converging roller 95 is assigned to the continuous printed web 4. The converging roller 94 is disposed above the converging roller 95 and thus forms an upper converging roller 94, while the converging roller 95 forms a lower converging roller 95.

A printed web pilot roller 97 is mounted below the lamination web pilot roller 80 in the first end region 79 so as to be rotatable on the bearing walls 78. The printed web pilot roller 97 extends horizontally and perpendicularly to the printed web conveying direction 98 of the continuous printed web 4 in the coupling/uncoupling assembly 76. Said printed web pilot roller 97 extends across the entire width of the continuous printed web 4 and is assigned to the latter.

A second adhesive tape application device 99 is disposed so as to be downstream of the printed web pilot roller 97 in terms of the printed web conveying direction 98. The first adhesive tape roller 83 is also a component part of the second adhesive tape application device 99. The first adhesive tape roller 83 is utilized by the first adhesive tape application device 82 as well as by the second adhesive tape application device 99.

The second adhesive tape application device 99 has a pivotable, or rotatable, respectively, second adhesive tape roller 100 which by way of a partial circumference supports an adhesion element 101. The second adhesive tape roller 100 extends horizontally and perpendicularly to the printed web conveying direction 98 of the continuous printed web 4. Said second adhesive tape roller 100 extends across the entire width of the continuous printed web 4. The second adhesive tape roller 100 in a vertical guide 102, which is disposed on the bearing walls 78, by means of a lifting device 103 is vertically displaceable between a lower inactive position and an upper active adhesive position, said second adhesive tape roller 100 in said upper active adhesive position, conjointly with the first adhesive tape roller 83, configuring an adhesive tape application gap.

The coupling/uncoupling assembly 76, in terms of the printed web conveying direction 98 of the continuous printed web 4, downstream comprises a perforating device 104 which is assigned to the continuous printed web 4. The perforating device 104 comprises an upper perforating roller 105 having an upper perforating assembly 106 which is disposed so as to be proximal to the circumference. The perforating device 104 furthermore has a lower perforating roller 107 having a lower perforating assembly 108 which is disposed so as to be proximal to the circumference. The perforating rollers 105, 107 are disposed on top of one another and so as to be pivotable. Said perforating rollers 105, 107 extend so as to be mutually parallel and horizontal. The perforating rollers 105, 107 run so as to be perpendicular to the printed web conveying direction 98 of the continuous printed web 4, and extend across the entire width of the continuous printed web 4. The lower perforating roller 107 along a vertical guide 110, which is disposed on the bearing walls 78, by means of a lifting device 109 is vertically displaceable between a lower inactive position and an upper perforating position.

A pair of deflection rollers 111, 112 is disposed between the lamination web separating counter-element 146 and the upper perforating roller 105. The deflection rollers 111, 112 extends so as to be mutually parallel and horizontal. Said deflection rollers 111, 112 are disposed so as to be mutually adjacent on top of one another. The upper deflection roller 111 is assigned to the continuous lamination web 40 and forms a lamination web deflection roller. The lower deflection roller 112 is assigned to the continuous printed web 4 and forms a printed web deflection roller. Each deflection roller 111, 112 is mounted so as to be pivotable in a controlled manner on the bearing walls 78 and is connected to out-of-round end plates 113 or 114, respectively.

A first lamination web/printed web deflection roller 115 which is connected to out-of-round end plates 116 is disposed between the lamination web separating counter-element 146 and the lamination web printed web converging installation 93. The first lamination web/printed web deflection roller 115 is mounted so as to be pivotable on the bearing walls 78 and extends horizontally. Said first lamination web/printed web deflection roller 115 runs so as to be perpendicular to the printed web conveying direction 98 of the continuous printed web 4, or to the lamination web conveying direction 81 of the continuous lamination web 40, respectively.

A printed web separating device 117 is disposed so as to be downstream of the lamination web printed web converging installation 93 in terms of the printed web conveying direction 98. The printed web separating device 117 comprises a printed web separating element 118 which extends horizontally and runs so as to be perpendicular to the printed web conveying direction 98 of the continuous printed web 4. Said printed web separating element 118 extends across the entire width of the continuous printed web 4, and along a vertical guide 119, which is disposed on the bearing walls 78, by means of a lifting device 120 is vertically displaceable between a lower inactive position and an upper separating position. The printed web separating element 118 is in the manner of a blade.

The printed web separating device 117 furthermore comprises a printed web separating counter-element 121 which is disposed so as to be locationally fixed on the bearing walls 78 and extends horizontally. The printed web separating counter-element 121 runs so as to be perpendicular to the printed web conveying direction 98 of the continuous printed web 4. Said printed web separating counter-element 121 in the manner of a platen extends across the entire width of the continuous printed web 4. Said printed web separating counter-element 121 supports the continuous printed web 4 from below when the continuous printed web 4 is being separated.

A second lamination web/printed web deflection roller 122 which is connected to out-of-round end plates 123 is disposed between the printed web separating counter-element 121 and the lamination web printed web infeed installation 93. The second lamination web/printed web deflection roller 122 is mounted so as to be pivotable on the bearing walls 78 and extends horizontally. Said second lamination web/printed web deflection roller 122 runs so as to be perpendicular to the printed web conveying direction 98 of the continuous printed web 4, or to the lamination web conveying direction 81 of the continuous lamination web 40, respectively.

The operation of the coupling/uncoupling assembly 76 will be explained in more detail hereunder.

Figure 5:
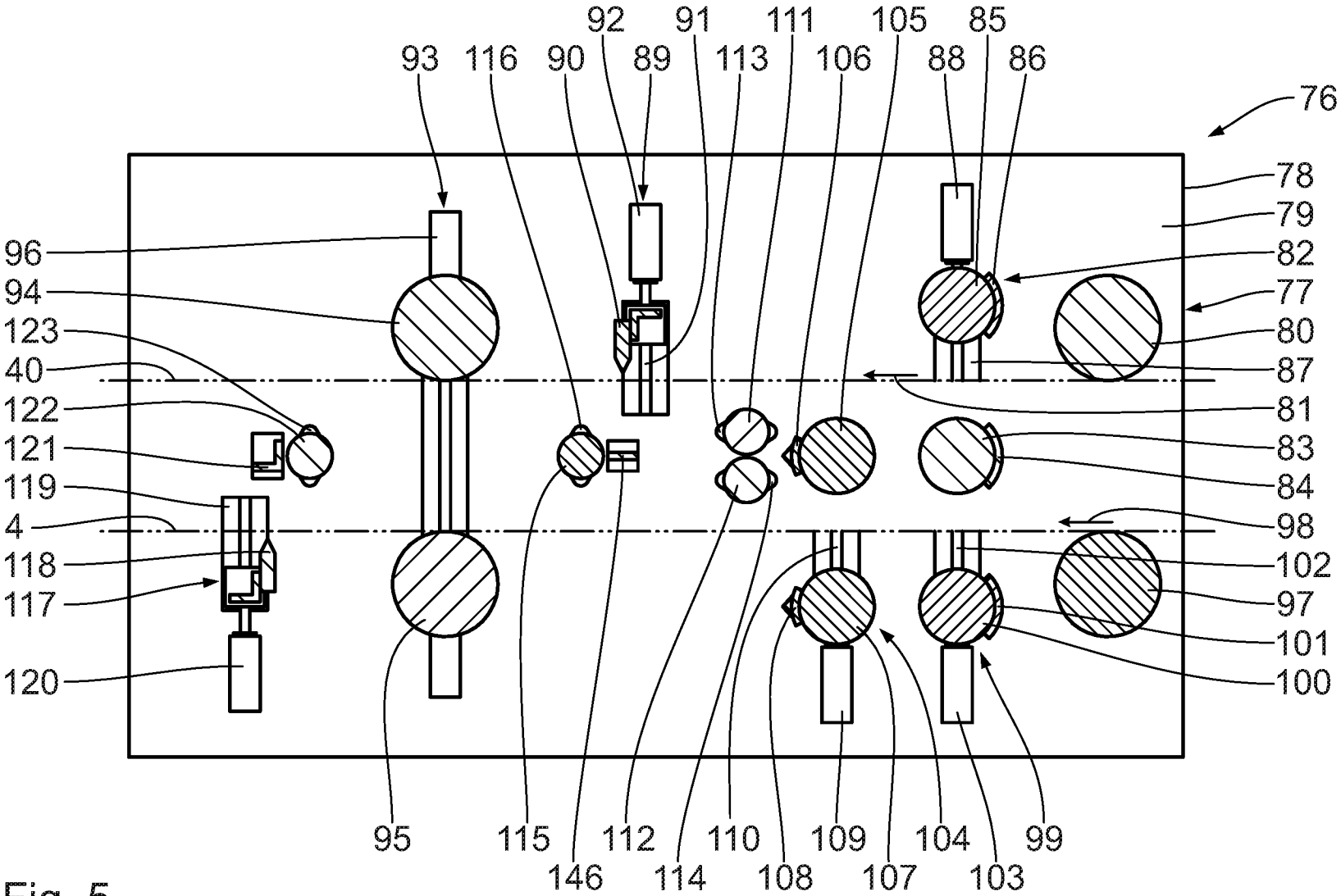
FIGS. 5 to 15 show individual longitudinally sectioned views of the coupling/uncoupling assembly shown in FIG. 4 when in operation.

The corrugated cardboard production assembly 1 and the printed web/lamination web production assembly 2 in FIG. 5 produce in a mutually independent manner. The continuous corrugated cardboard web which is laminated on both sides is produced in the corrugated cardboard production assembly 1, while the continuous printed web 4 which can be printed by means of the inkjet printing device 58 and the continuous lamination web 40 are produced in the printed web/lamination web production assembly 2.

The continuous lamination web 40 and the continuous printed web 4 in the coupling/uncoupling assembly 76 in identical respective conveying directions 81 and 98 of said webs 40 and 4, respectively, are conveyed on top of one another in a mutually separate manner Said continuous lamination web 40 and said continuous printed web 4 in the coupling/uncoupling assembly 76 run so as to be horizontal and parallel, but mutually spaced apart.

The continuous lamination web 40 runs below the lamination web pilot roller 80 and the upper converging roller 94 and is in contact with the latter two. The lamination web pilot roller 80 and the upper converging roller 94 guide the continuous lamination web 40. The adhesive tape counter-roller 85 and the lamination web separating element 90 are in each case situated in the upper inactive position thereof.

Said adhesive tape counter-roller 85 and said lamination web separating element 90 are disposed so as to be spaced apart from the continuous lamination web 40 and above the latter.

The continuous lamination web 40 moreover runs above and so as to be spaced apart from the first adhesive tape roller 83, the upper perforating roller 105, the upper deflection roller 111, the lamination web separating counter-element 146, the first lamination web/printed web deflection roller 115, and the second lamination web/printed web deflection roller 122.

The continuous printed web 4 at the top contacts the printed web pilot roller 97 and the lower converging roller 95. The printed web pilot roller 97 and the lower converging roller 95 guide the continuous printed web 4.

The continuous printed web 4 runs above and so as to be spaced apart the second adhesive tape roller 100, the lower perforating roller 107, and the printed web separating element 118 which are all situated in the lower inactive position thereof.

The continuous printed web 4 runs below and so as to be spaced apart from the first adhesive tape roller 83, the upper perforating roller 105, the lower deflection roller 112, the first lamination web/printed web deflection roller 115, and the second lamination web/printed web deflection roller 122.

The continuous printed web 4 is wound in the printed web winding device 66. The continuous lamination web 40 by way of the lamination web transfer assembly 3 is transferred to the corrugated cardboard production assembly 1 and in the connecting device, while being glued, is connected to the continuous corrugated cardboard web 6 which is laminated on one side.

The lamination web transfer assembly 3 comprises a first deflection bar 124 and a second deflection bar 125. The first deflection bar 124 in the printed web/lamination web production assembly 2, in terms of the conveying direction 81 of the continuous lamination web 40, is disposed downstream of the coupling/uncoupling assembly 76. Said first deflection bar 124 extends horizontally and, conjointly with the conveying direction 81 of the continuous lamination web 40 present there, encloses an angle which is 45°. The continuous lamination web 40 is deflected by 90° and turned over by 180° at the first deflection bar 124. The continuous lamination web 40 in the lamination web transfer assembly 3 thus runs so as to be perpendicular to a longitudinal direction of the corrugated cardboard production assembly 1.

The second deflection bar 125 runs parallel to the first deflection bar 124. Said second deflection bar 125 is situated within the corrugated cardboard production assembly 1. The continuous lamination web 40 by the second deflection bar 125 is deflected by 90° in the direction of the corrugated cardboard conveying direction and is turned over by 180°. The continuous lamination web 40, downstream of the second deflection bar 125, is conveyed in the conveying direction of the adjacent continuous corrugated cardboard web 6 which is laminated on one side. The second deflection bar 125 is disposed between the material web splicing device 8 and the pre-heating assembly 37.

Figure 6:
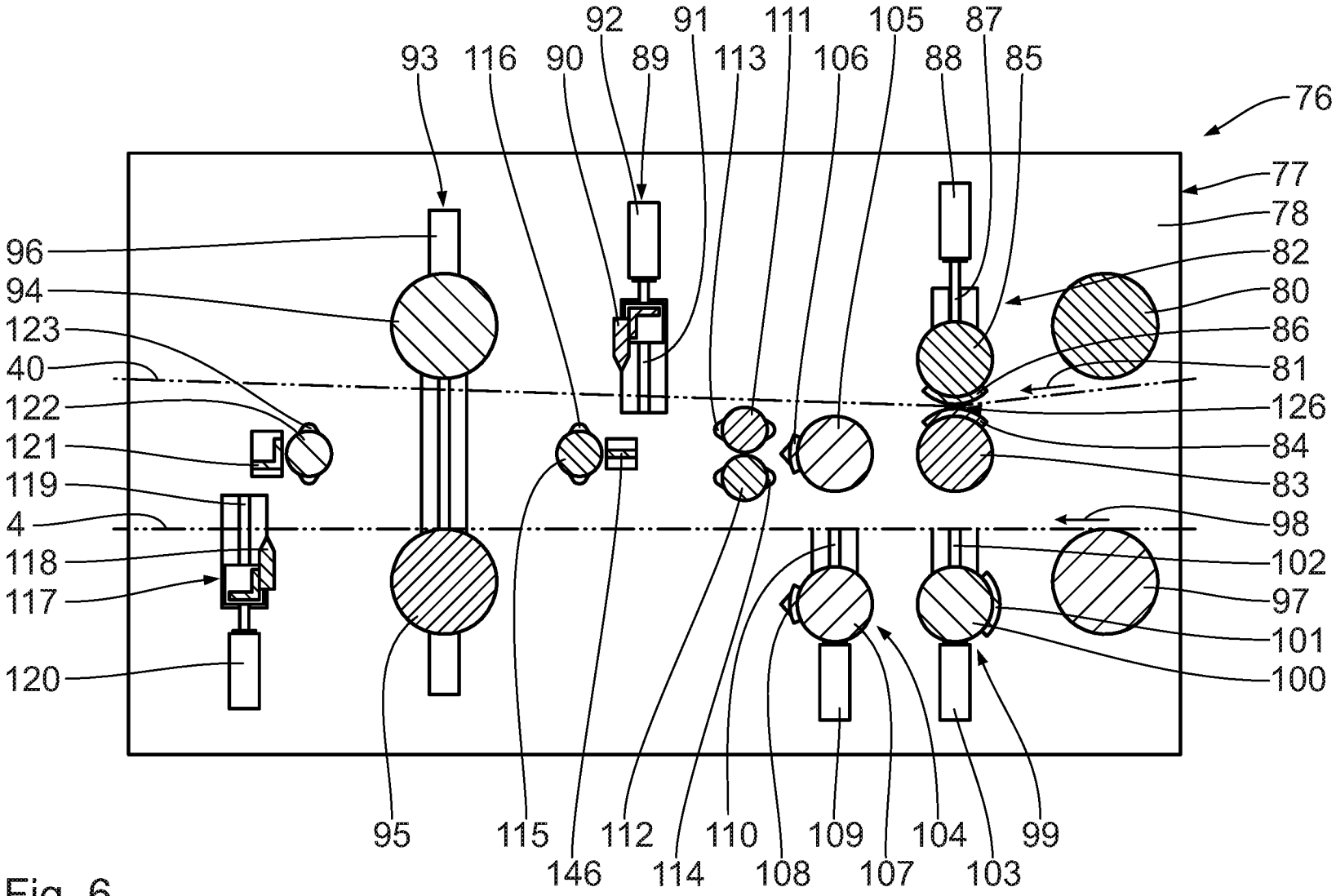

When the continuous printed web 4 is to be utilized as the lamination web in the corrugated cardboard production assembly 1, the continuous printed web 4 has to be introduced into the corrugated cardboard production assembly 1 and the inkjet printing device 58 has to be coupled to the corrugated cardboard production assembly 1, so to speak. To this end, the first adhesive tape application device 82 is put in operation. The adhesive tape counter-roller 85 is displaced downward in the direction toward the first adhesive tape roller 83. Said adhesive tape counter-roller 85 therein entrains the continuous lamination web 40 downward, on account of which the latter is lifted from the lamination web pilot roller 80 and the upper converging roller 94. When the adhesive tape counter-roller 85 is displaced downward, the latter and the first adhesive tape roller 83 are pivoted or rotated, respectively, in such a manner that the counter-element 86 and deviation elements 84 face one another and come to bear on opposite ends on the continuous lamination web 40. A first adhesive tape 126 which is held by the adhesion element 84 herein is disposed in an adhesive manner in the direction of the width of the continuous lamination web 40 on that side of the latter that faces the continuous printed web 4, thus on the lower side. To this end, the first adhesive tape roller 83 from the adhesive tape receiving position is pivoted or rotated, respectively, to the adhesive tape transferring position. Said first adhesive tape roller 83 acts as an adhesive tape application roller. The adhesive tape counter-roller 85 herein prevents that the endless lamination web 40 is diverted. The printed web splicing device 44 and the corrugated cardboard production assembly 1 continue to produce (FIG. 6).

Figure 7:
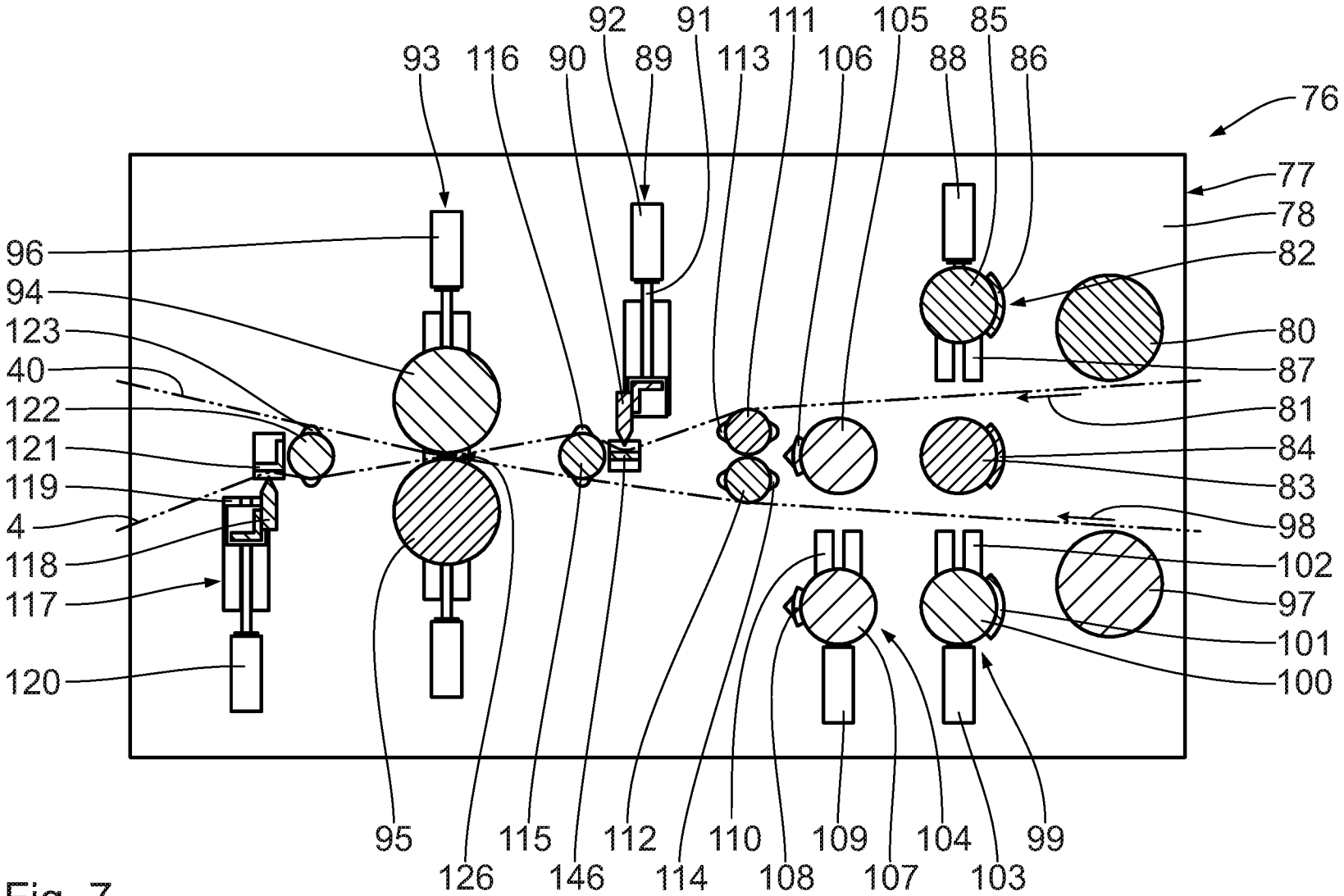

As is shown in FIG. 7, the adhesive tape counter-roller 85 is subsequently displaced upward again to the inactive position thereof. The first adhesive tape roller 83 is pivoted or rotated, respectively, again to the inactive position thereof. The converging rollers 94, 95 are uniformly converged. Said converging rollers 94, 95 herein are converged in such a manner that the continuous lamination web 40 and the continuous printed web 4 contact one another at the first adhesive tape 126, on account of which said continuous lamination web 40 and said continuous printed web 4 are coupled or connected to one another, respectively, by means of the first adhesive tape 126.

Moreover, the lamination web separating device 89 is put in operation. The lamination web separating element 90 is displaced to the lower separating position thereof. Said lamination web separating element 90 therein interacts with the lamination web separating counter-element 92 while separating the continuous lamination web 40.

The continuous lamination web 40 bears on the top of the upper deflection roller 111, the first lamination web/printed web deflection roller 115, and the second lamination web/printed web deflection roller 122. The continuous printed web 4 bears on the bottom of the second deflection roller 112, the first lamination web/printed web deflection roller 115, and the second lamination web/printed web deflection roller 122.

Moreover, the printed web separating device 117 is put in operation. To this end, the printed web separating element 118 is displaced upward to the upper separating position thereof, wherein said printed web separating element 118 with the aid of the printed web separating counter-element 121 separates the continuous printed web 4.

Figure 8:
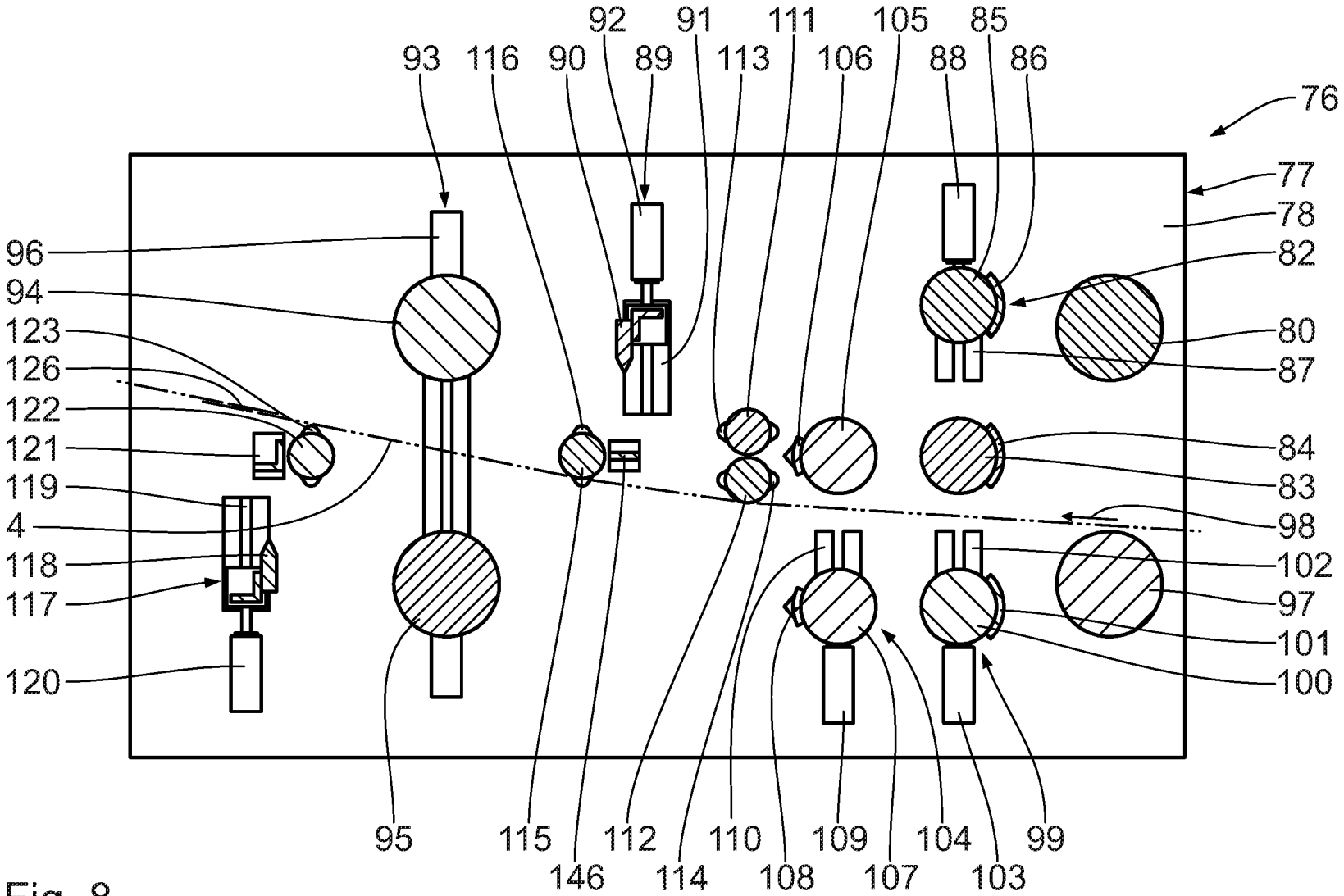

As is shown in FIG. 8, only the continuous printed web 4 is still being conveyed through the coupling/uncoupling assembly 76. Only the continuous printed web 4 is still being produced in the printed web/lamination web production assembly 2. The continuous printed web 4 from the first end region 79 runs upward. Said continuous printed web 4 bears on the bottom of the lower deflection roller 112, on the bottom of the first lamination web/printed web deflection roller 115, and on the top of the second lamination web/printed web deflection roller 122. The continuous printed web 4 which has been printed as the lamination web is transferred to the corrugated cardboard production assembly 1 by way of the lamination web transfer assembly 3. Said continuous printed web 4 as the lamination web, while being glued, is connected in the connecting device of the corrugated cardboard web 6 which is laminated on one side. The inkjet printing device 58 is coupled to the corrugated cardboard production assembly 1.

Figure 9:
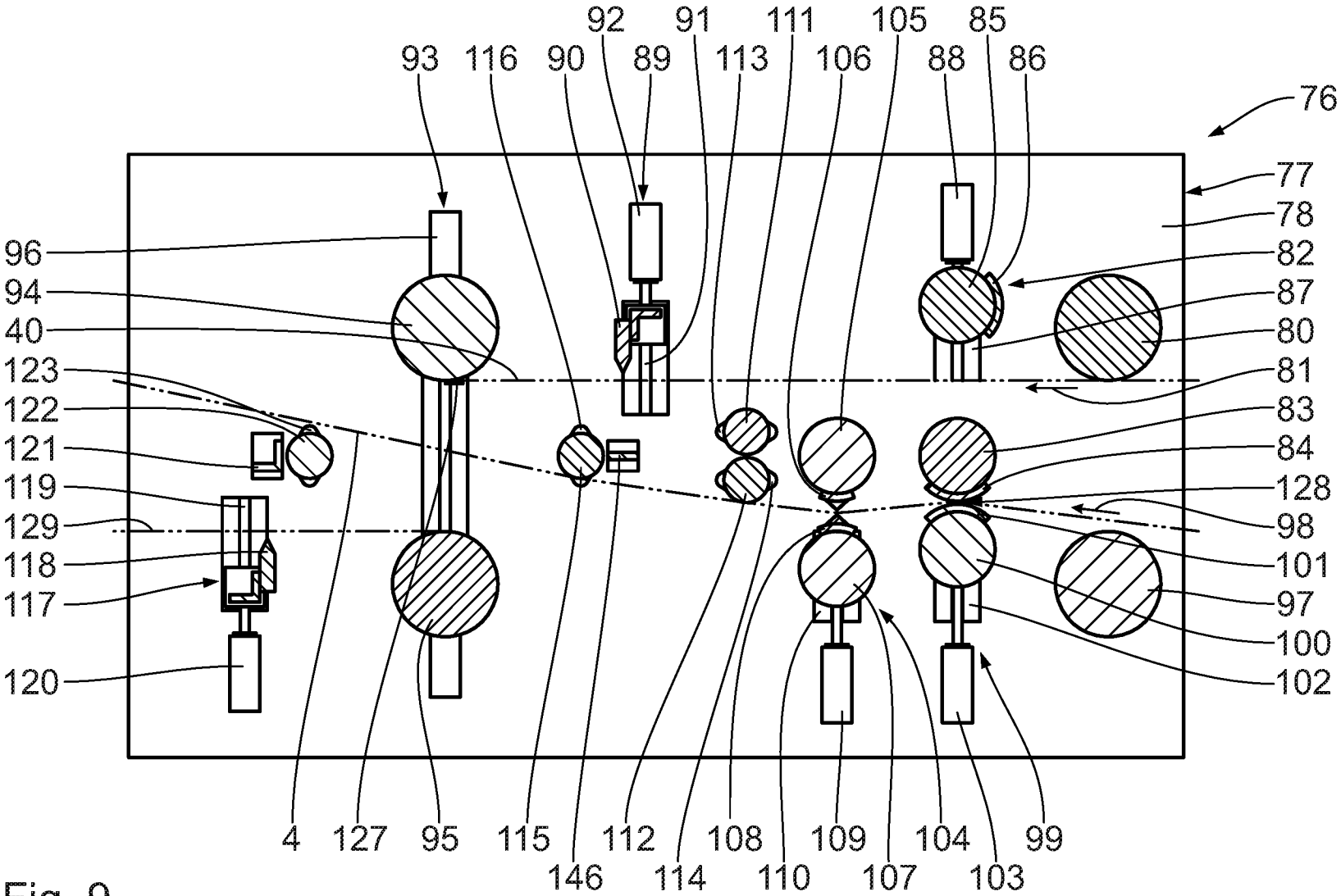

The uncoupling of the inkjet printing device 58 from the corrugated cardboard production assembly 1 will be explained in the following. As is shown in FIG. 9, the continuous lamination web 40 from the lamination web splicing device 70 is introduced into the coupling/uncoupling assembly 76. Said continuous lamination web 40 bears on the bottom of the lamination web pilot roller 80 and of the upper converging roller 94. The first adhesive tape application device 82 and the lamination web separating device 89 are inactive.

In the region of the upper converging roller 94, a second adhesive tape 127 is disposed in the direction of the width so as to be proximal to the end of continuous lamination web 40 on that side that faces the continuous printed web 4, thus on the lower side of said lamination web 40. The continuous lamination web 40 is in this instance locationally established on the upper converging roller 94. The upper converging roller 94 is embodied as a vacuum roller, for example. Alternatively, said upper converging roller 94 for this purpose is assigned a clamping beam, for example.

The wound web 129, which corresponds to the printed web 4 and may be printed, from the printed web winding device 66 is introduced into the coupling/uncoupling assembly 76. The end of said wound web 129 is placed from above onto the lower converging roller 95. The wound web 129 in this instance is locationally established on the lower converging roller 95. The lower converging roller 95 is embodied as a vacuum roller, for example. Alternatively, said lower converging roller 95 for this purpose is assigned a clamping beam, for example.

The second adhesive tape application device 99 and the perforating device 104 are activated. The second adhesive tape roller 100 is displaced upward and, from the adhesive tape receiving position thereof, is pivoted or rotated, respectively, to the adhesive tape transferring position thereof. The first adhesive tape roller 83 is likewise pivoted or rotated, respectively. A third adhesive tape 128 is disposed from below on the continuous printed web 4 by means of the second adhesive tape roller 100, said third adhesive tape 128 extending in the direction of the width of said continuous printed web 4. Said second adhesive tape roller 100 acts as an adhesive tape application roller. The first adhesive tape roller 83 now act as an adhesive tape counter-roller and herein prevents that the continuous printed web 4 is diverted. The corrugated cardboard production assembly 1 and the inkjet printing device 58 produce in coupled operation.

The lower perforating roller 107 is displaced upward and moved to the perforating position thereof. The upper perforating roller 105 is pivoted or rotated, respectively, to the perforating position thereof. The perforating rollers 105, 107 in the perforating positions thereof interact and perforate the continuous printed web 4 across the entire width of the latter. The perforating assemblies 106, 108 herein face one another.

The continuous printed web 4 bears on the bottom of the second deflection roller 112 and on the bottom of the first lamination web/printed web deflection roller 115, as well as on the top of the second lamination web/printed web deflection roller 122.

Figure 10:
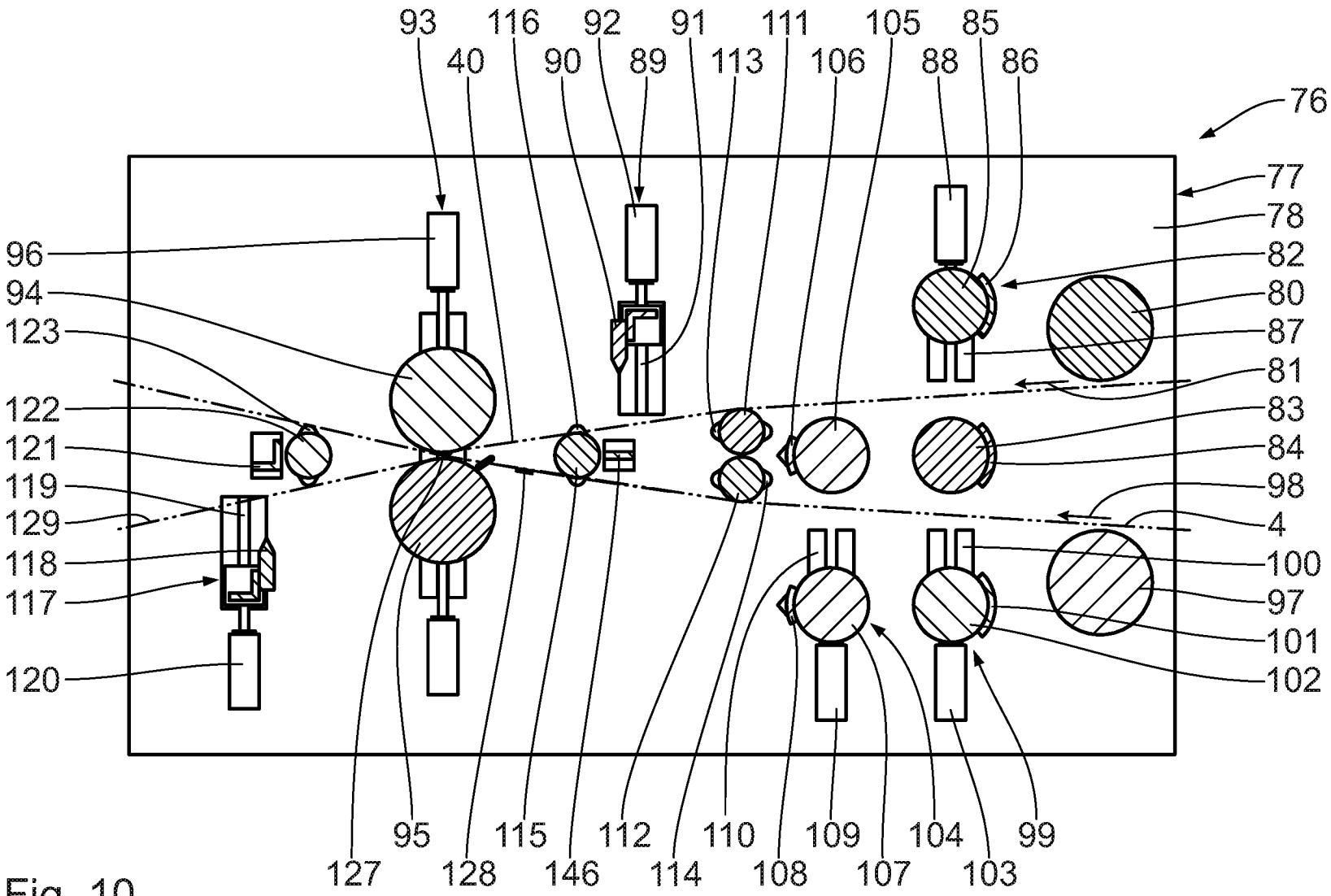

As is shown in FIG. 10, the lamination web printed web converging installation 93 is subsequently activated. The converging rollers 94, 95 are uniformly converged. The continuous lamination web 40 therein is adhesively bonded to the continuous printed web 4 by means of the second adhesive tape 127.

The continuous lamination web 40 bears on the top of the upper deflection roller 111, the first lamination web/printed web deflection roller 115, and the second lamination web/printed web deflection roller 122.

The continuous printed web 4 bears on the bottom of the lower deflection roller 112, the first lamination web/printed web deflection roller 115, and the second lamination web/printed web deflection roller 122.

Figure 11:
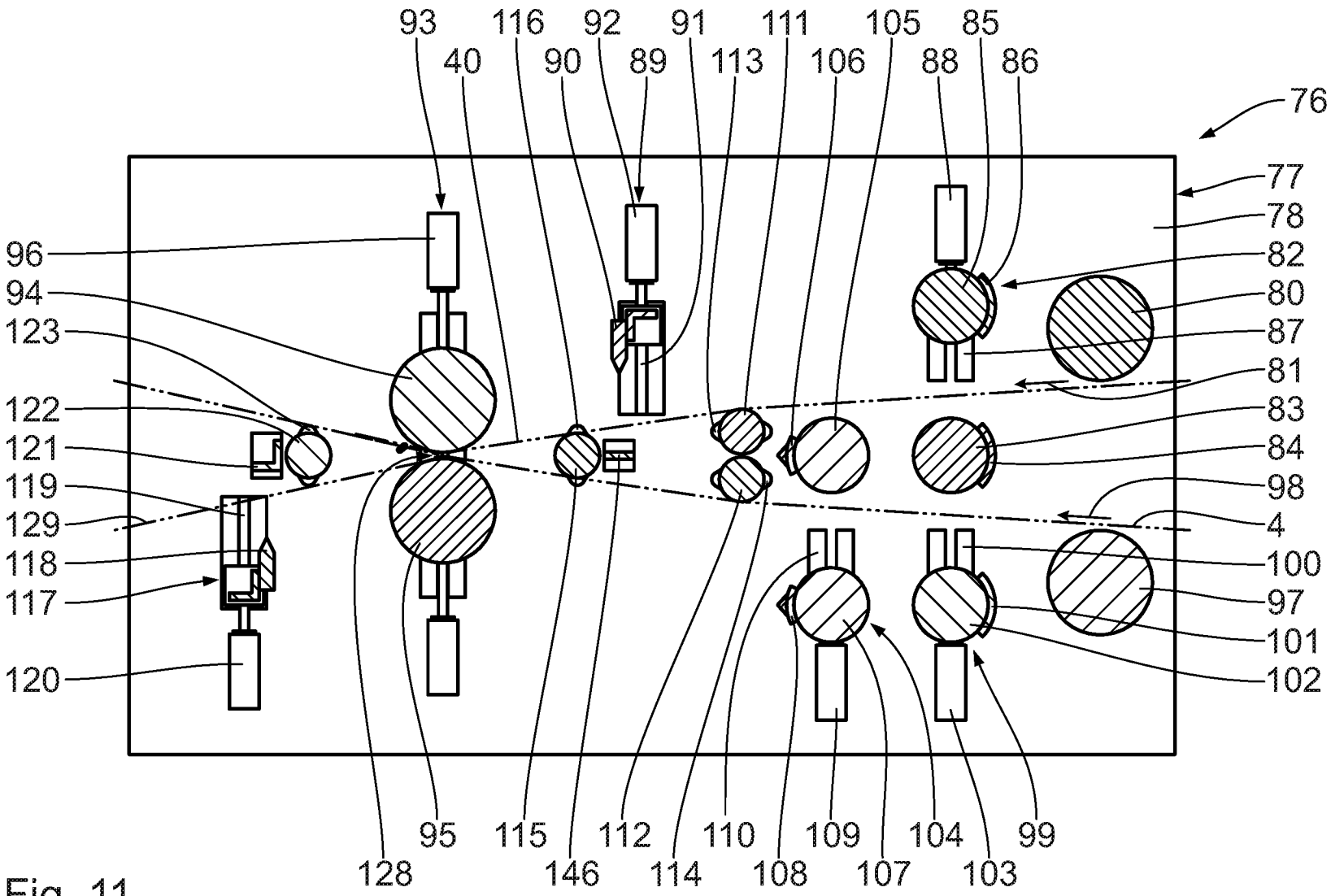

The wound web 129 emanating from the printed web winding device 66 is subsequently connected in an adhesive manner to the continuous printed web 4 by means of the third adhesive tape 128 (FIG. 11).

Figure 12:
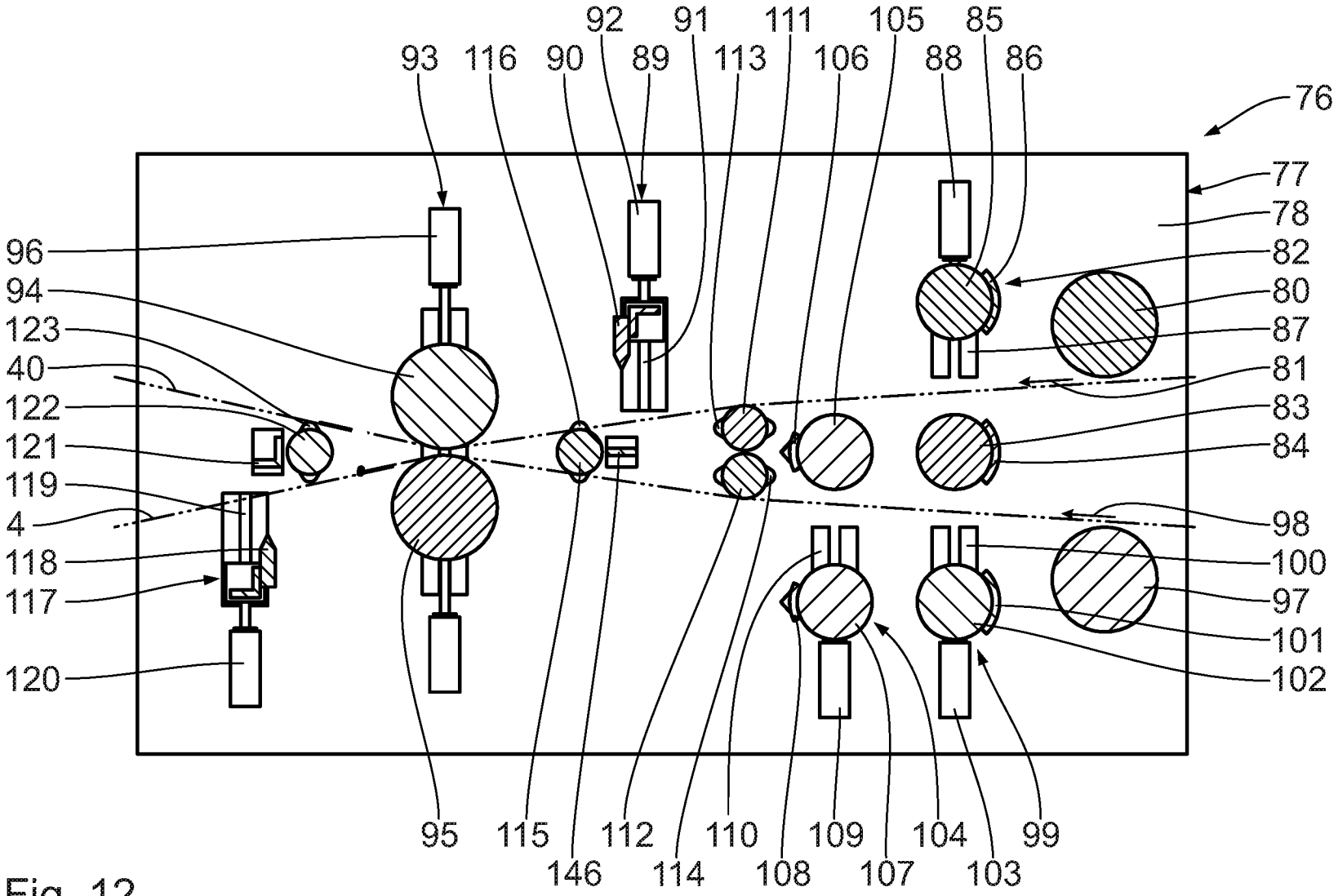
Figure 13:
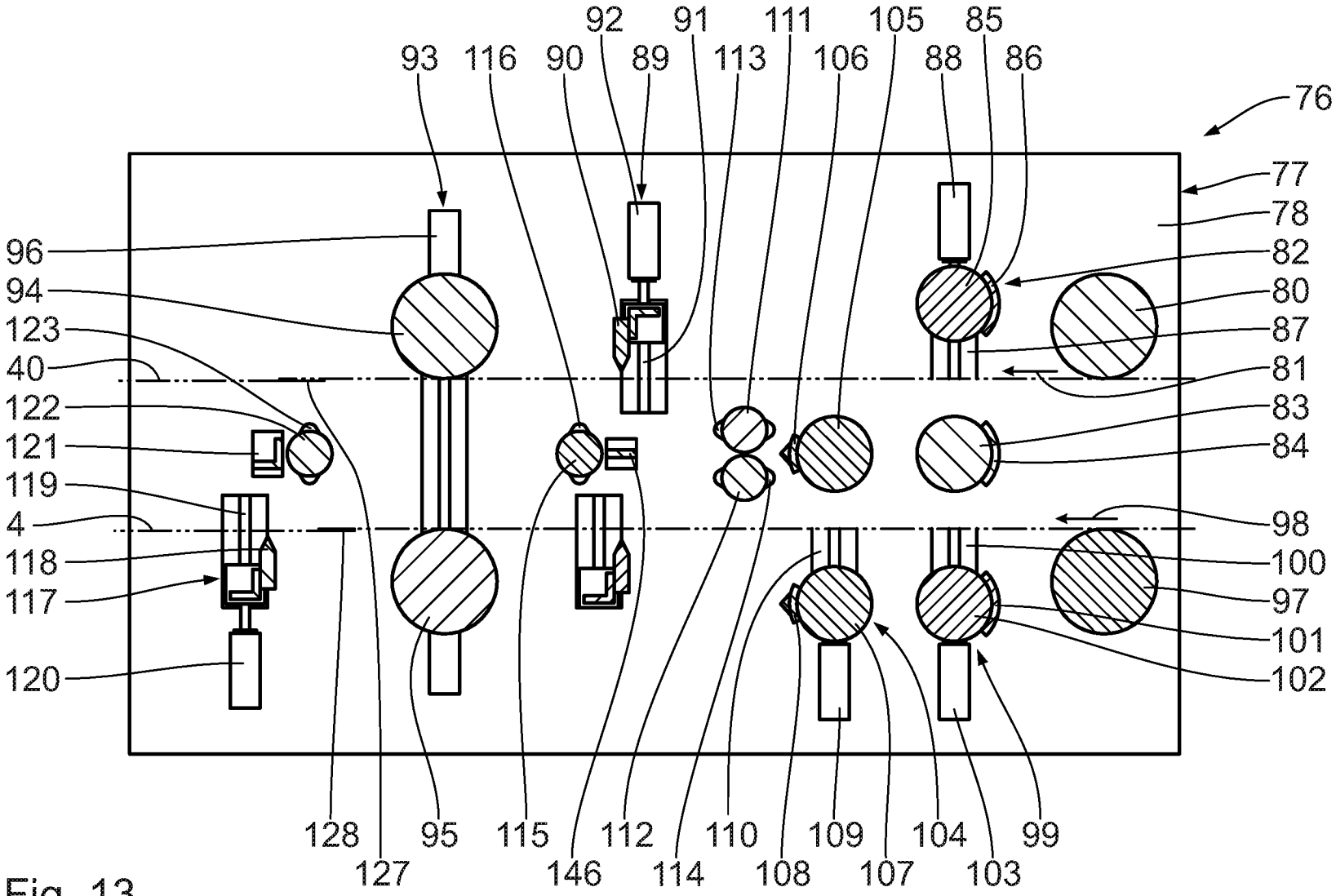
Figure 14:
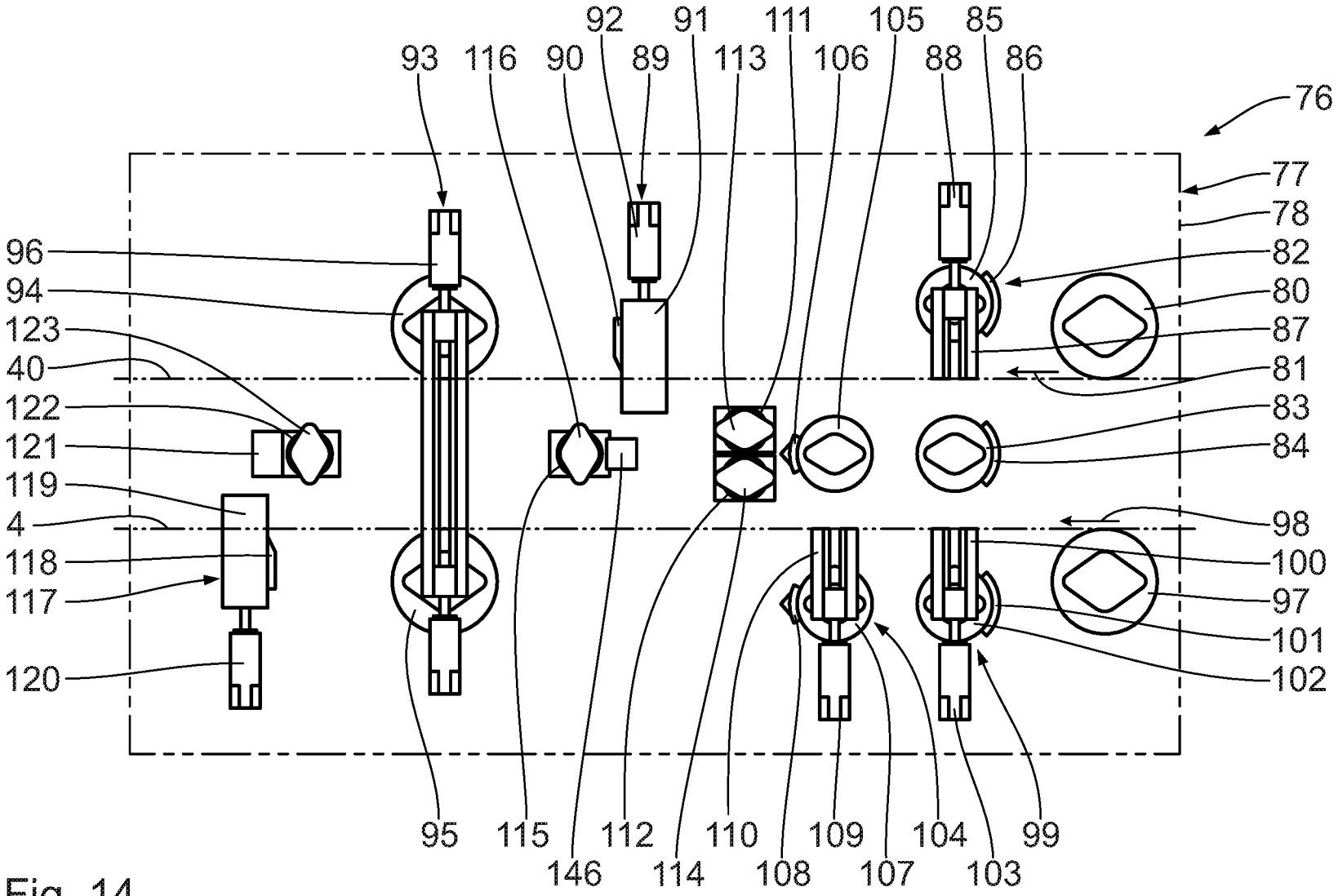
Figure 15:
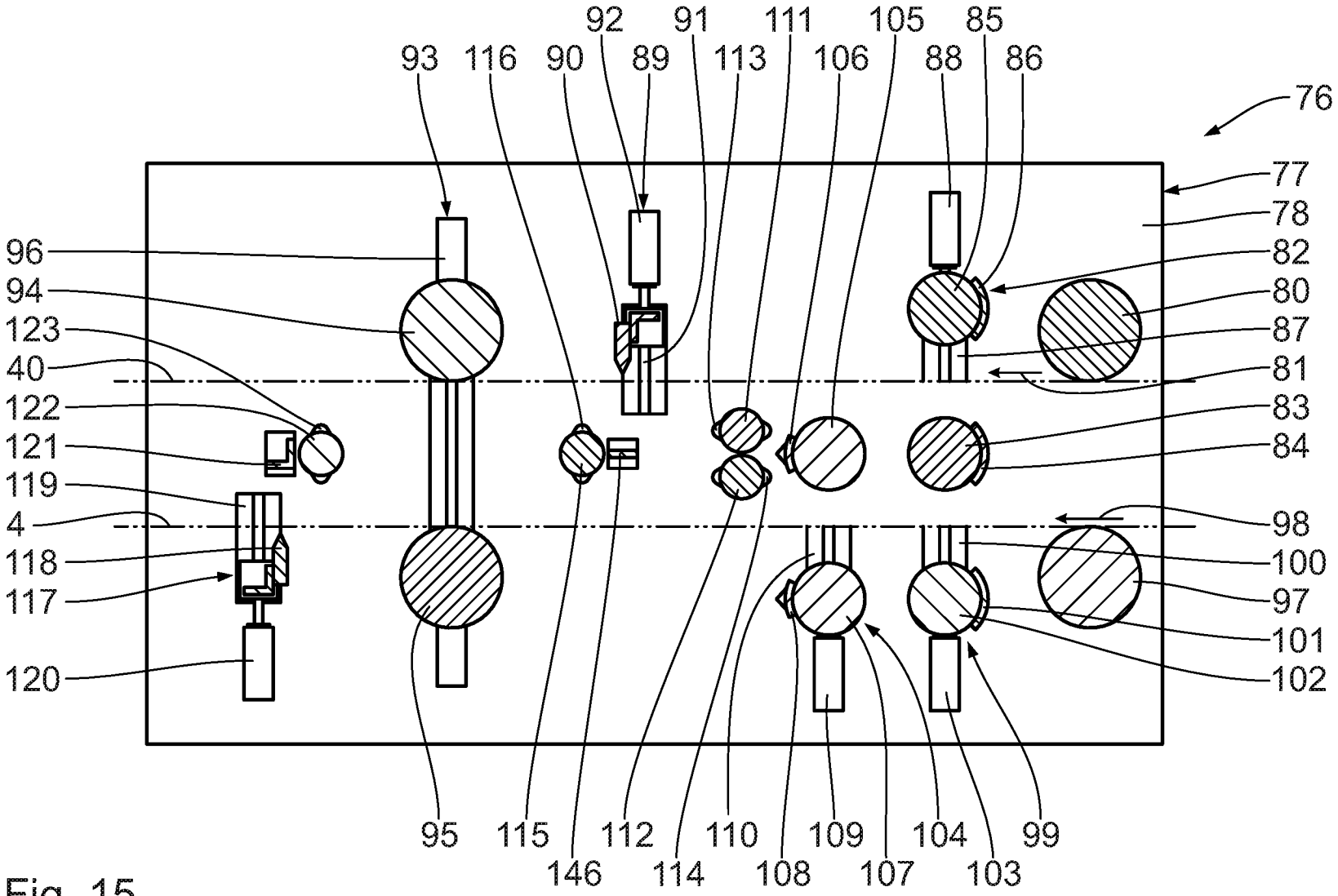
Figure 16:
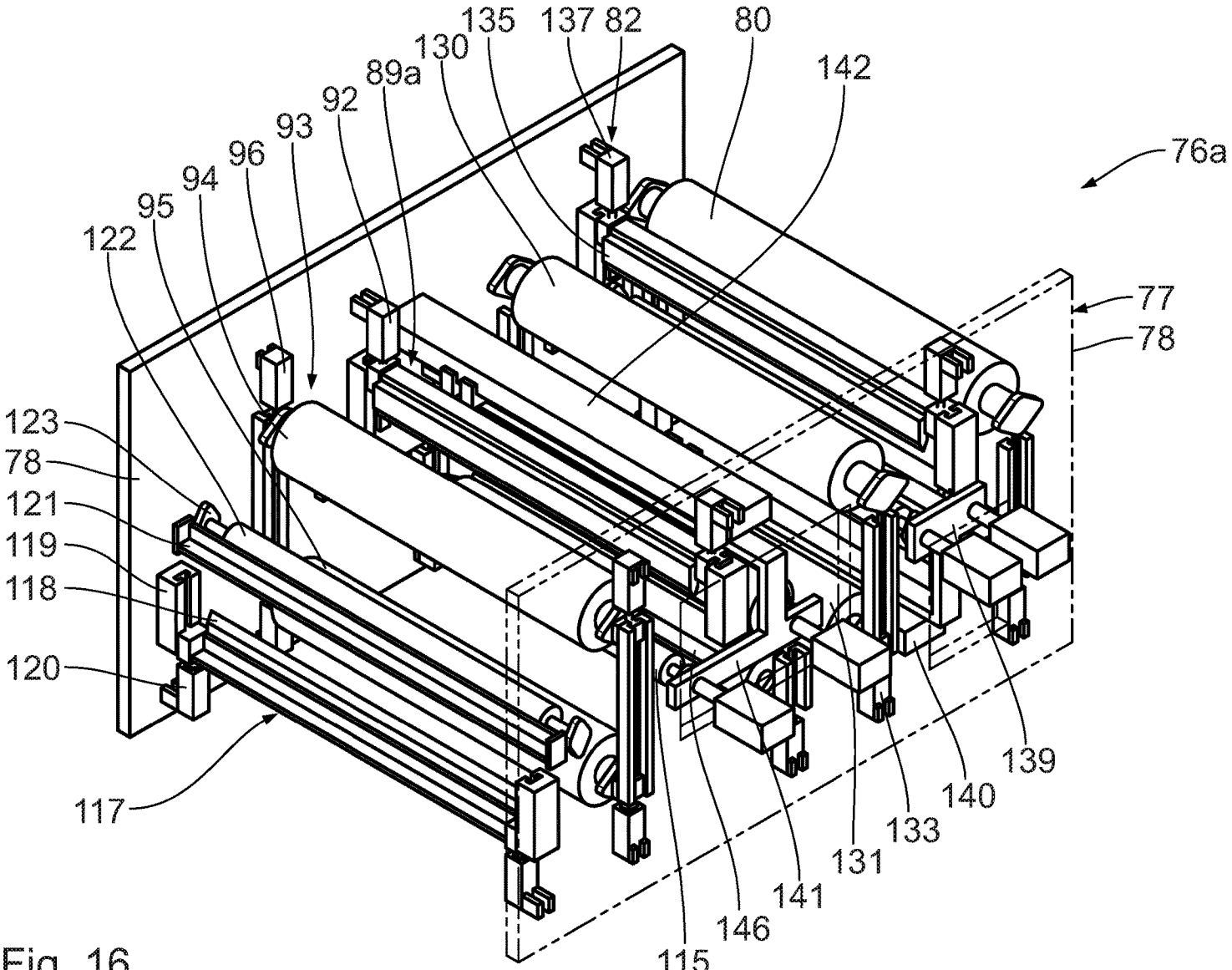
FIG. 16 shows a perspective view of a coupling/uncoupling assembly according to the invention, according to a second embodiment.
Figure 17:
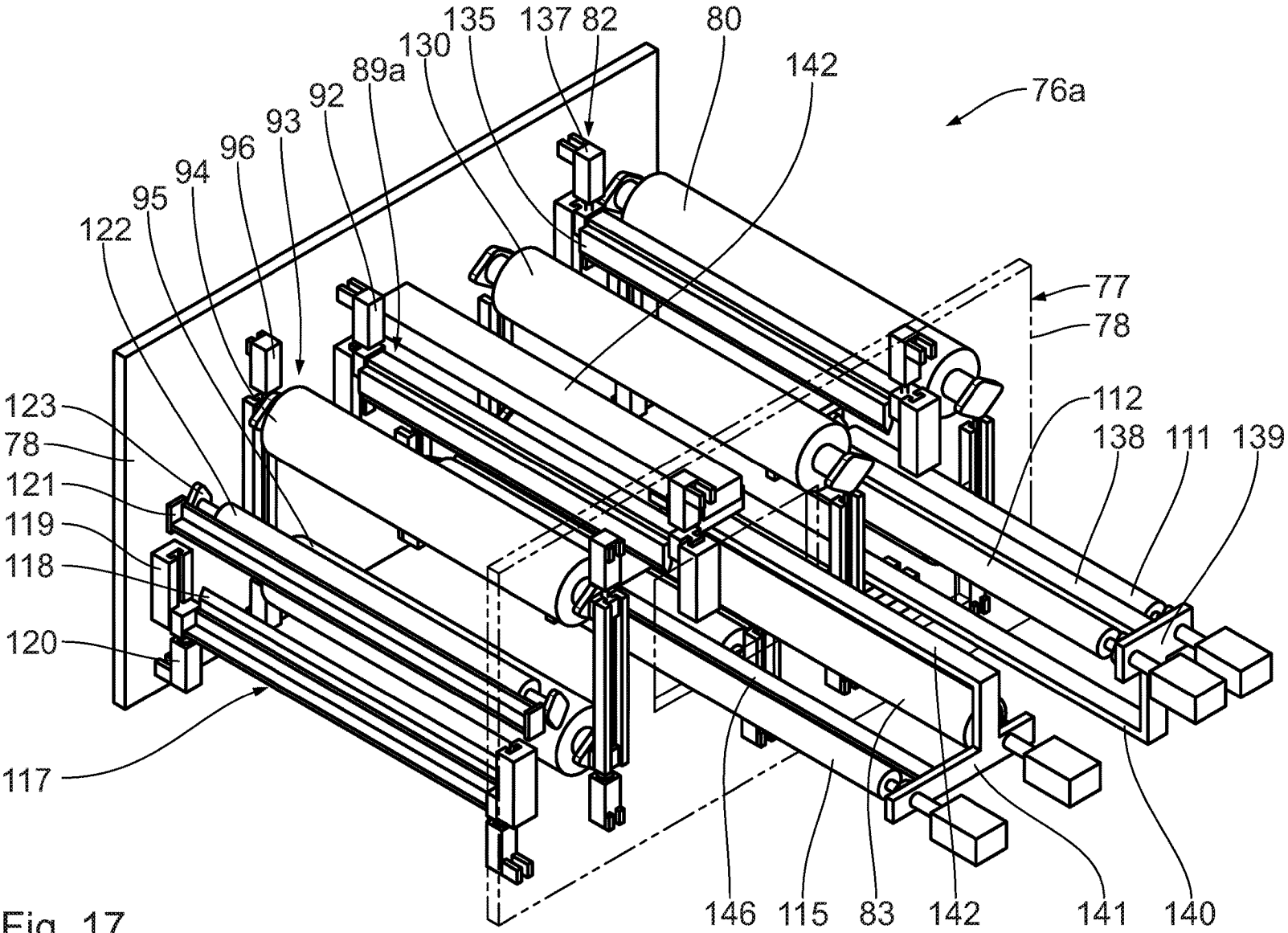
FIG. 17 shows a perspective view of the coupling/uncoupling assembly according to FIG. 16 when being converted.

As is shown in FIG. 12, the originally continuous printed web 4 downstream of the lamination web printed web converging installation 93 tears along the perforation generated by the perforating device 104. The converging rollers 94, 95 are subsequently diverged again (FIG. 13). The corrugated cardboard production assembly 1 and the inkjet printing device 58 are uncoupled. The continuous lamination web 40 is again utilized in the corrugated cardboard production assembly 1.

A second embodiment of the coupling/uncoupling assembly will be described hereunder with reference to FIGS. 16 to 28. There are no other points of differentiation. Identical parts are provided with the same reference signs as in the preceding embodiment, reference being made to the latter. Functionally identical parts which however differ in terms of construction are provided with the same reference signs and the suffix "a".

In comparison to the first embodiment, the printed web pilot roller 97 in the coupling/uncoupling assembly **76*a* is vertically displaceable along a vertical guide 147 which is disposed on the bearing walls 78**.

The coupling/uncoupling assembly **76*a* furthermore has an upper deflection roller 130 which is mounted so as to be rotatable on the bearing walls 78. A lower deflection roller 131 is disposed below the upper deflection roller 130. The lower deflection roller 131, along a vertical guide 132 which is disposed on the bearing walls 78, by means of a lifting device 133** is displaceable between a lower pilot position and an upper contact pressure position.

A printed web separating device 134 is disposed between the pair formed by the lamination web pilot roller 80 and the printed web pilot roller 97 and the pair formed by the upper deflection roller 130 and the lower deflection roller 131. The printed web separating device 134 comprises a printed web separating element 135 which by means of a lifting device 137 is vertically displaceable along a vertical guide 136 which is disposed on the bearing walls 78. The printed web separating device 134 furthermore comprises a printed web separating counter-element 138 which in the manner of a block or a platen, respectively, is assigned to the printed web separating element 135.

The printed web separating counter-element 138 is disposed on a removable first slide 139. The first slide 139 is displaceable along a first rail 140 which runs horizontally and is disposed on the bearing walls 78. The first slide 139 can be completely retrieved from the frame 77.

The first slide 139 furthermore supports a pair of deflection rollers 111, 112 which in comparison to the first exemplary embodiment are disposed beside one another with the printed web separating counter-element 138 being disposed therebetween.

The lamination web separating device 89*a* in comparison to the first embodiment has the lamination web separating counter-element 146 on a second slide 141 which is displaceable along a horizontal second rail 142. The second rail 142 is disposed on the bearing walls 78. The second slide 141 can be completely retrieved from the frame 77.

The second slide 141 moreover supports the first lamination web/printed web deflection roller 115 and the adhesive tape roller 83 which is assigned to the vertically displaceable adhesive tape counter-roller 100.

Figure 18:
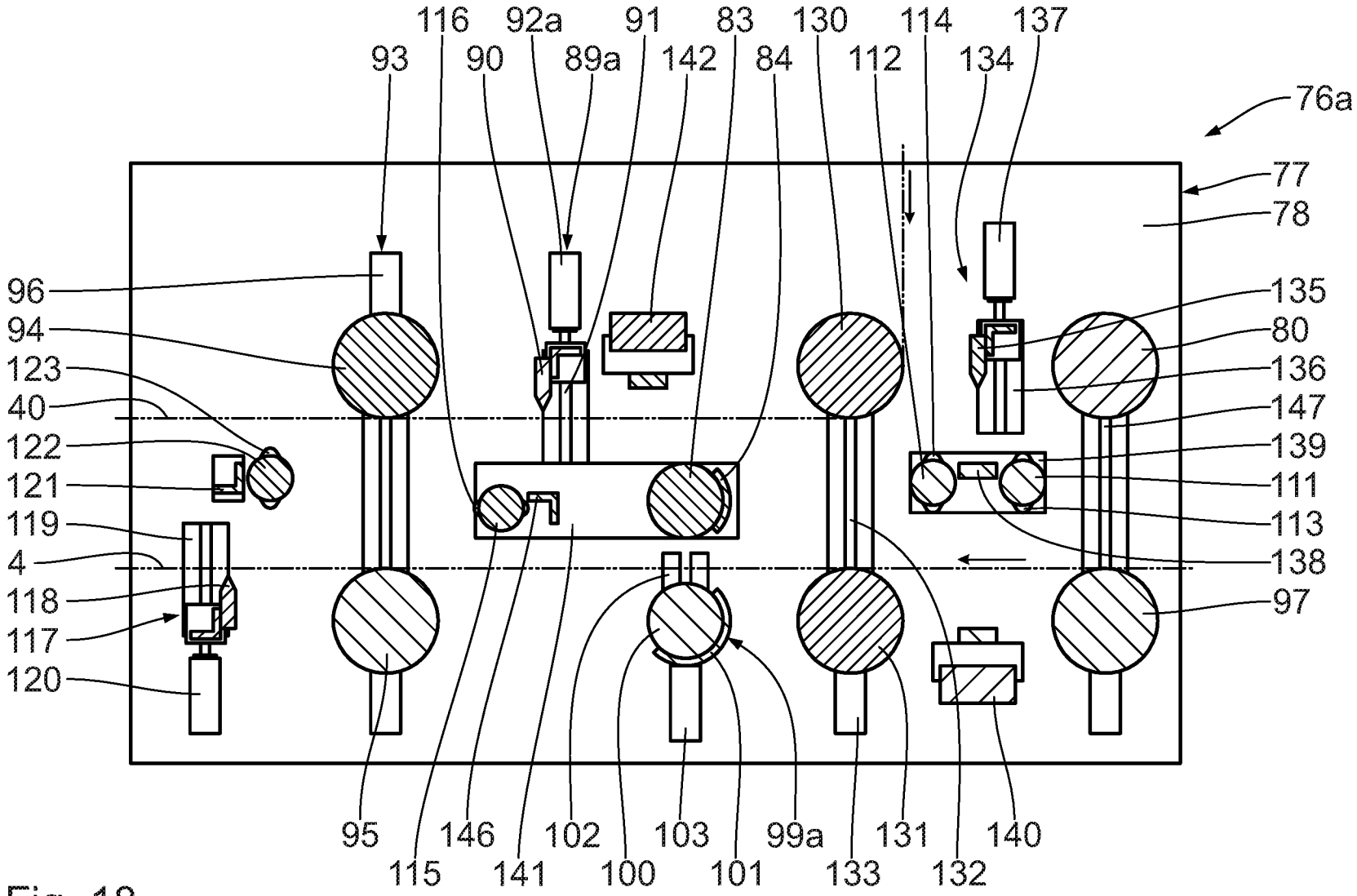
FIGS. 18 to 28 show individual longitudinally sectioned views which show the coupling/uncoupling assembly according to FIGS. 16, 17 when in operation.

The corrugated cardboard production assembly 1 and the printed web/lamination web production assembly 2 according to FIG. 18 produce in a mutually independent manner. The corrugated cardboard web which is laminated on both sides is produced in the corrugated cardboard production assembly 1, while the continuous printed web 4 and the continuous lamination web 40 are produced in the printed web/lamination web production assembly 2. The slides 139, 141 are pushed into the frame 77.

The continuous lamination web 40 from the lamination web splicing device 70 enters the coupling/uncoupling assembly 76*a* from above. Said continuous lamination web 40 is deflected by 90° by the upper deflection roller 130 and runs horizontally downstream of the latter. The continuous lamination web 40 bears on the bottom of the upper converging roller 94.

The lamination web separating device 89*a* is situated in the inactive position thereof.

The continuous printed web 4 runs horizontally in the coupling/uncoupling assembly 76*a*. Said continuous printed web 4 contacts the printed web pilot roller 97, the lower deflection roller 131, and the lower converging roller 95. The printed web pilot roller 97 is situated in the lower inactive position thereof. The lower deflection roller 131 is situated in the lower pilot position thereof. The lower converging roller 95 is situated in the lower inactive position thereof. The adhesive tape counter-roller 100 and the printed web separating device 117 are inactive.

Figure 19:
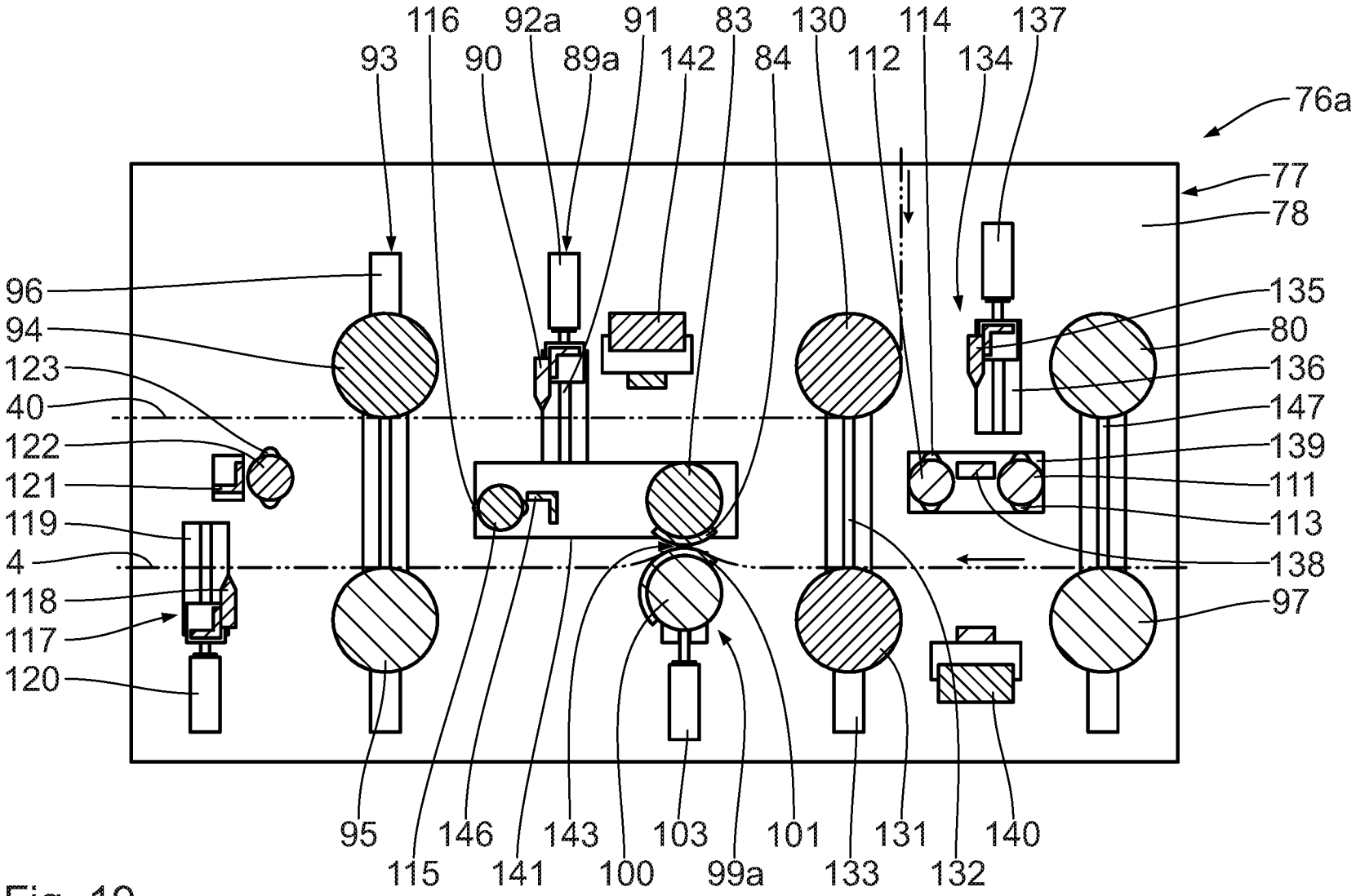

As is shown in FIG. 19, a first adhesive tape 143, which extends across the entire width of the continuous printed web 4, by means of the adhesive tape application device 99*a* is disposed from above on the continuous printed web 4 for coupling the inkjet printing device 58 to the corrugated cardboard production assembly 1. To this end, the adhesive tape roller 83 and the adhesive tape roller 100 are pivoted or rotated. The adhesive tape roller 83 acts as an adhesive tape application roller. The first adhesive tape 143, which is held by the adhesive tape roller 83, in the adhesive tape transferring position is disposed above on the continuous printed web 4. The adhesive tape roller 100 is situated in the upper active position thereof and acts as an adhesive tape counter-roller.

Figure 20:
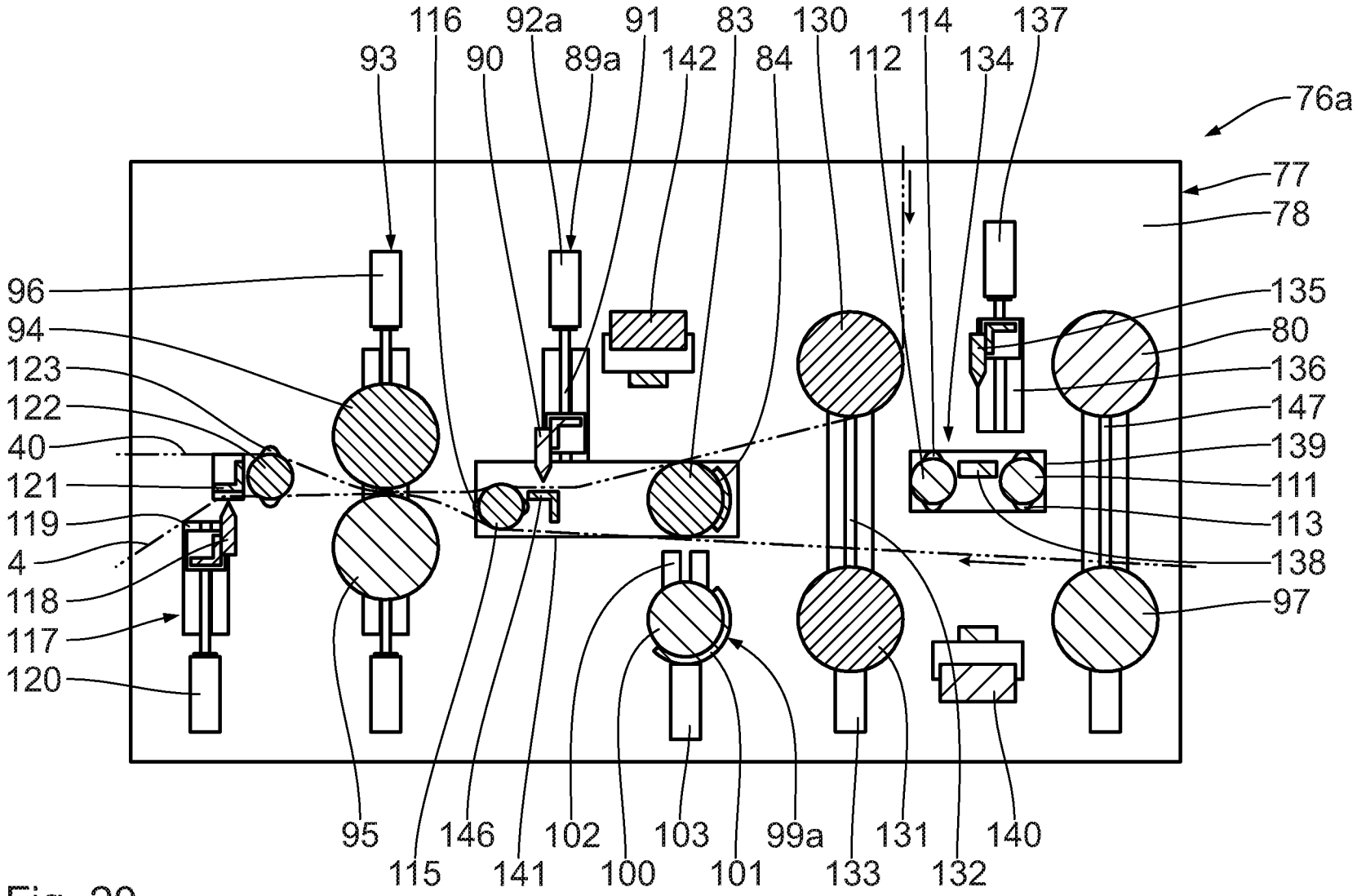
Figure 21:
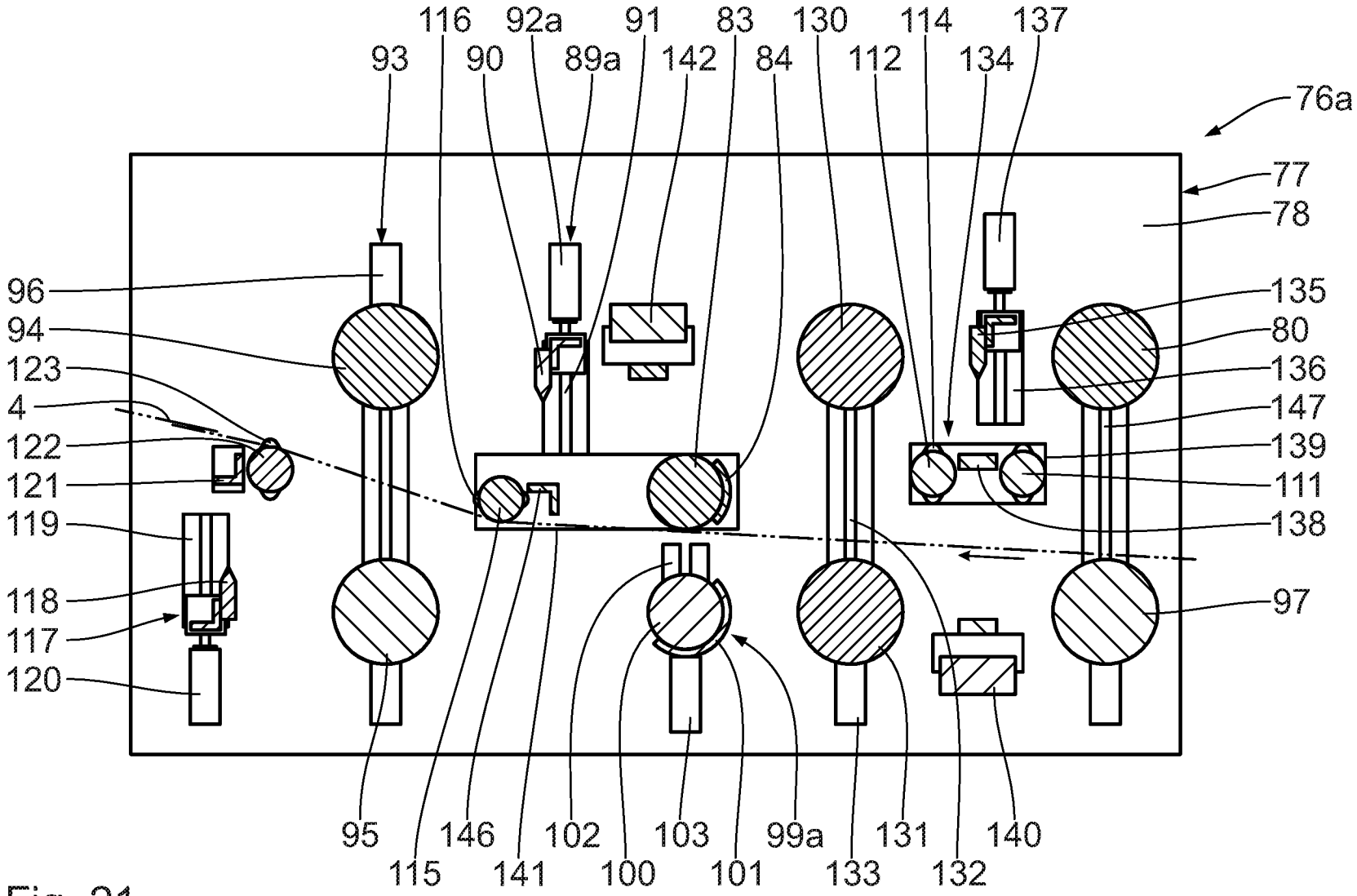

As is visualized in FIG. 20, the upper and the lower converging rollers 94, 95 are thereafter converged, on account of which the continuous printed web 4 and the continuous lamination web 40 are converged and adhesively connected to one another in the region of the first adhesive tape 143. The continuous lamination web 40 herein is brought to bear on the adhesive tape roller 83 and the first lamination web/printed web deflection roller 115 as well as the second lamination web/printed web deflection roller 122. The continuous printed web 4 comes to bear on the adhesive tape roller 83 and the first lamination/printed web deflection roller 115, as well as the second lamination web/printed web deflection roller 122.

The lamination web separating device 89*a* is activated. The lamination web separating element 90 is displaced from below to the separating position thereof and with the aid of the lamination separating counter-element 146 separates the continuous lamination web 40.

The printed web separating device 117 is activated. The printed web separating element 118 is displaced upward to the separating position thereof and with the aid of the printed web separating counter-element 121 separates the continuous printed web 4.

The corrugated cardboard production assembly 1 and the printed web/lamination web production assembly 2 produce in the coupled state. A continuous printed web 4 is produced and as a lamination web is transferred to the corrugated cardboard production assembly 1. This is visualized in FIG. 21.

Figure 22:
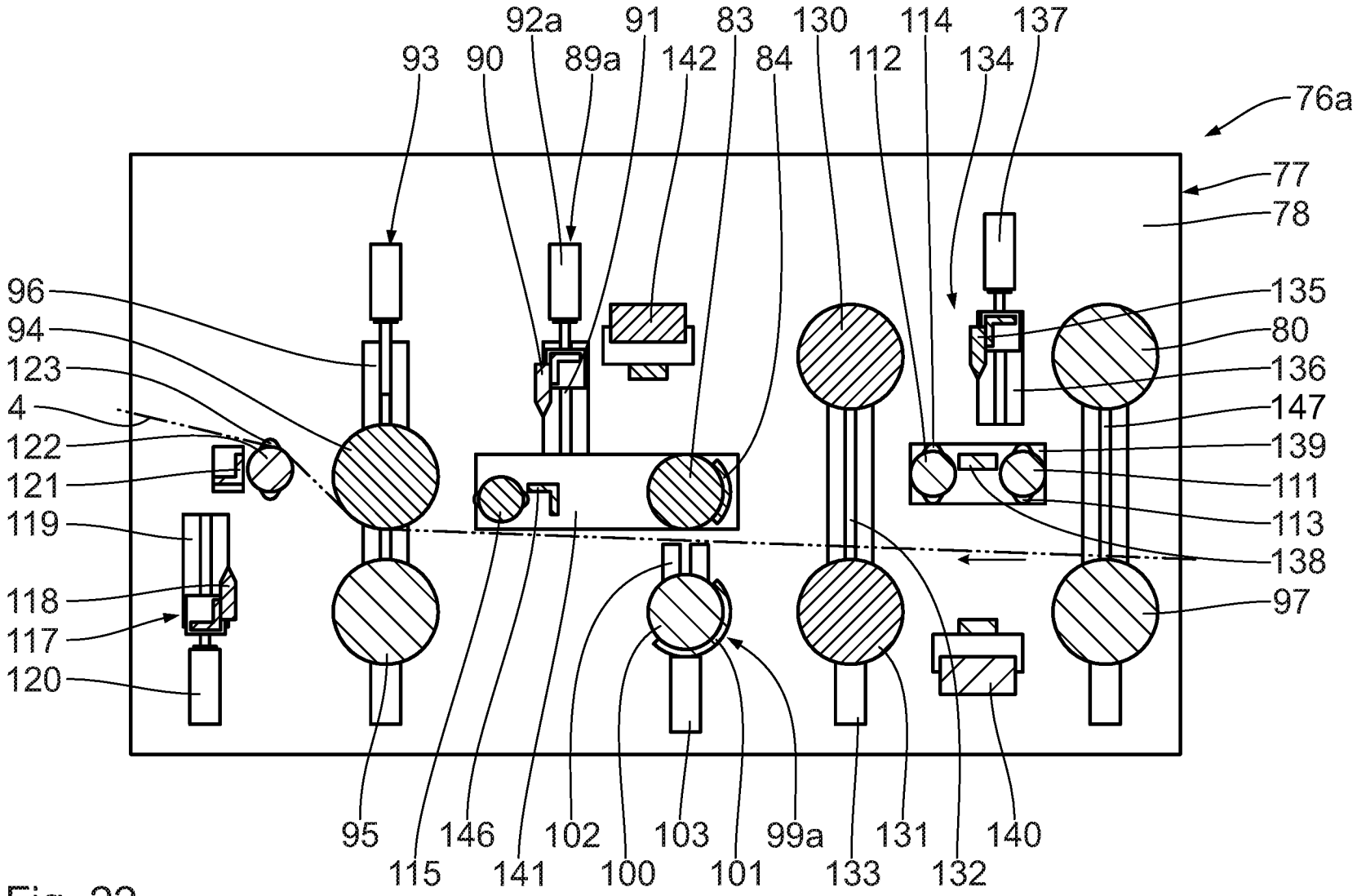

Retooling of the coupling/uncoupling assembly 76*a* is required for uncoupling the inkjet printing device 58 and the corrugated cardboard production assembly 1. To this end, the upper converging roller 94 is displaced downward such that the continuous printed web 4 is lifted from the adhesive tape roller 83 and the first lamination web/printed web deflection roller 115. The continuous printed web 4 is held under tension (FIG. 22).

Figure 23:
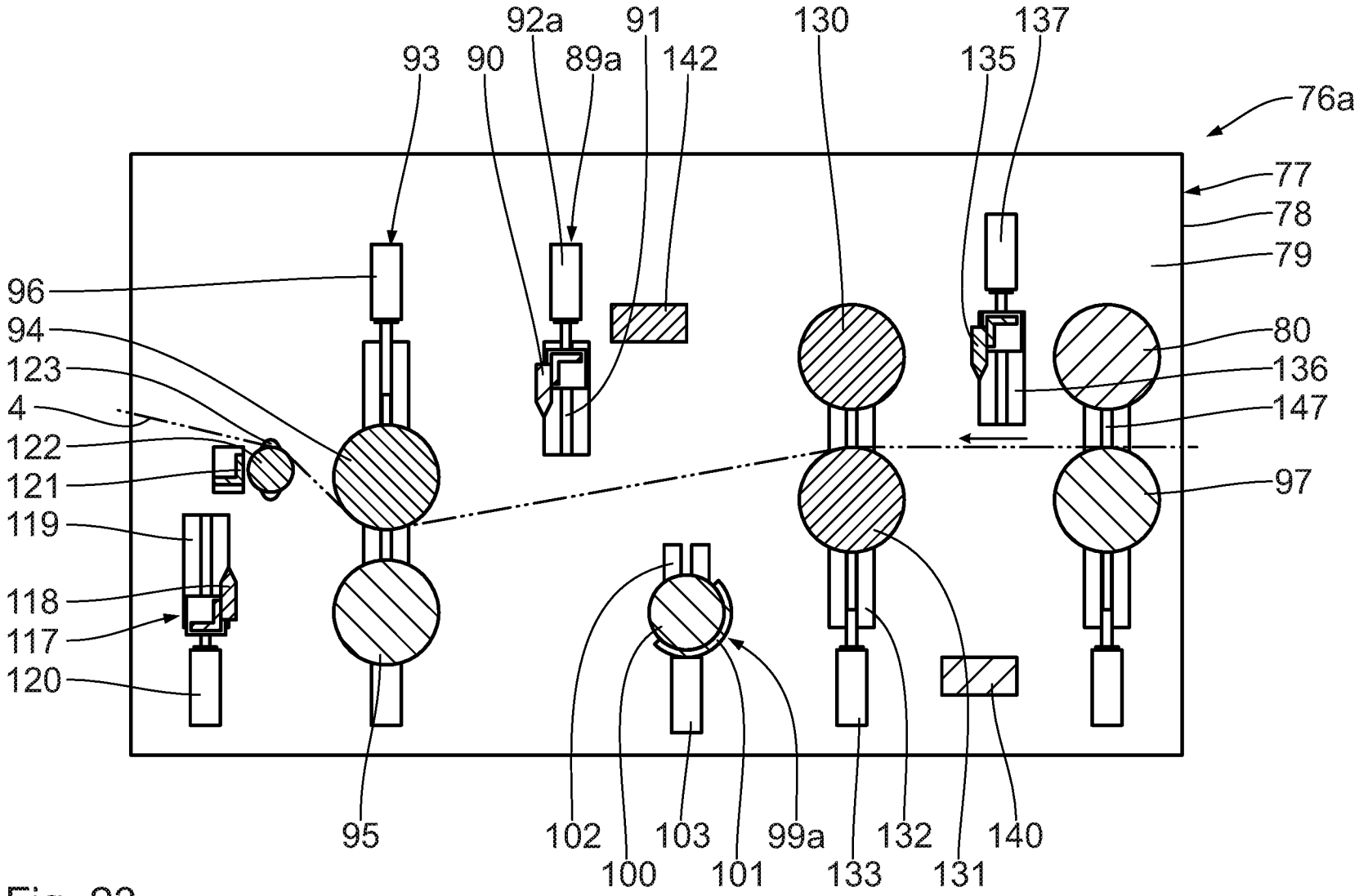

The slides 139, 141 are subsequently moved laterally out of the frame 77. The printed web pilot roller 97 and the lower deflection roller 131 are subsequently displaced upward (FIG. 23).

The first slide 139 is subsequently inserted again below the continuous printed web 4.

Figure 24:
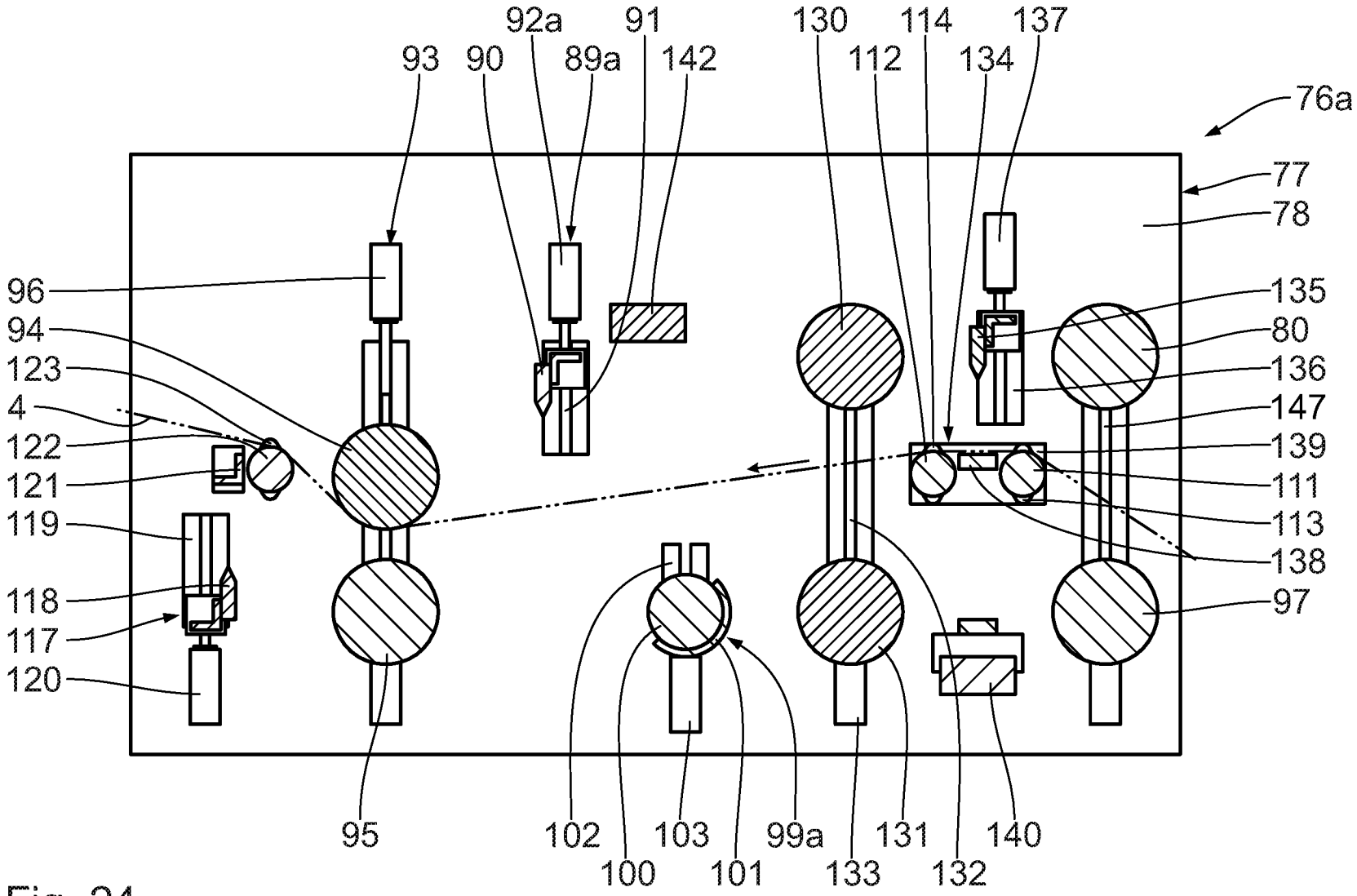

The continuous printed web 4 bears on the top of the deflection rollers 111, 112. The printed web pilot roller 97 and the lower deflection roller 131 are subsequently displaced downward again (FIG. 24).

Figure 25:
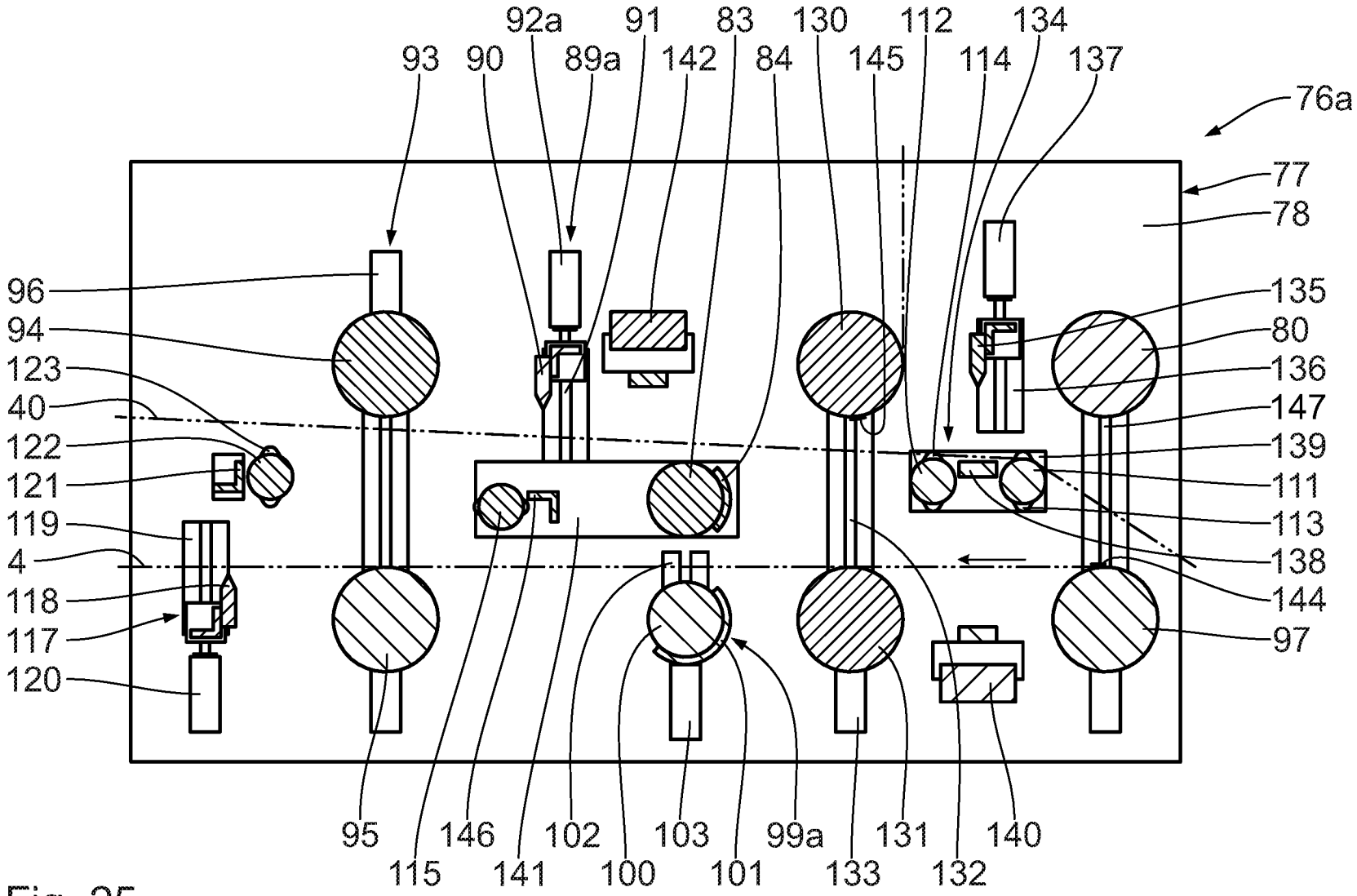

As is shown in FIG. 25, the upper converging roller 94 is thereafter displaced upward again, wherein said upper converging roller 94 herein is lifted from the continuous printed web 4.

The second slide 141 is pushed back in again below the continuous lamination web 40.

The previously continuous printed web 4, or wound web 129, respectively, from the printed web winding device 66 is introduced into the coupling/uncoupling assembly 76*a*. Said printed web 4 or wound web 129, respectively, bears on the top of the lower converging roller 95, the lower deflection roller 131, and the printed web pilot roller 97. The continuous printed web 4 is situated below the second slide 141. One end of the printed web 4, or the wound web 129, respectively, bears on the top of the printed web pilot roller 97. It is expedient for the printed web 4, or the wound web 129, respectively, there to be locationally fixed in relation to the printed web pilot roller 97. For example, the printed web pilot roller 97 is embodied as a vacuum roller which is active in this instance. For example, the printed web pilot roller 97 is assigned at least one clamping means such as a clamping beam.

A second adhesive tape 144 which extends across the entire width of the continuous printed web 4 is disposed on the top of the end of the continuous printed web 4 in the region of the printed web pilot roller 97.

The continuous lamination web of the corrugated cardboard production assembly 1 is introduced into the coupling/uncoupling assembly 76*a* from the top. A third adhesive tape 145 which extends across the entire width of the continuous lamination web 40 is disposed on the bottom of the continuous lamination web in the region of the upper deflection roller 130 of the corrugated cardboard production assembly 1. The continuous lamination web of the corrugated cardboard production assembly 1 herein is locationally established on the upper deflection roller 130. One end of the continuous lamination web of the corrugated cardboard production assembly 1 is now situated at the bottom of the upper deflection roller 130. For example, the upper deflection roller 130 is embodied as a vacuum roller which is active in this instance. Alternatively, the upper deflection roller 130 is assigned at least one clamping means such as a clamping beam, for example.

Figure 26:
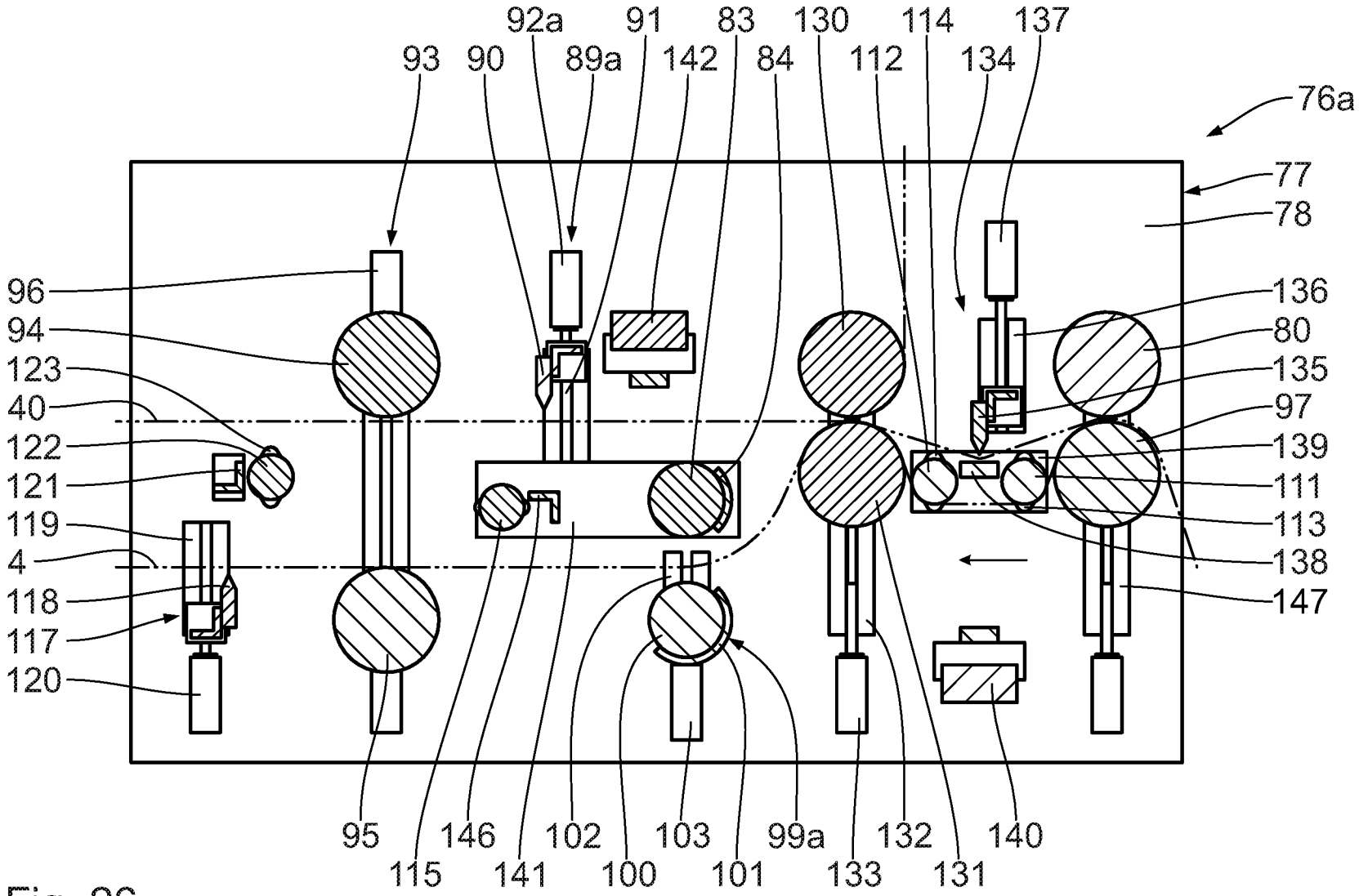
Figure 27:
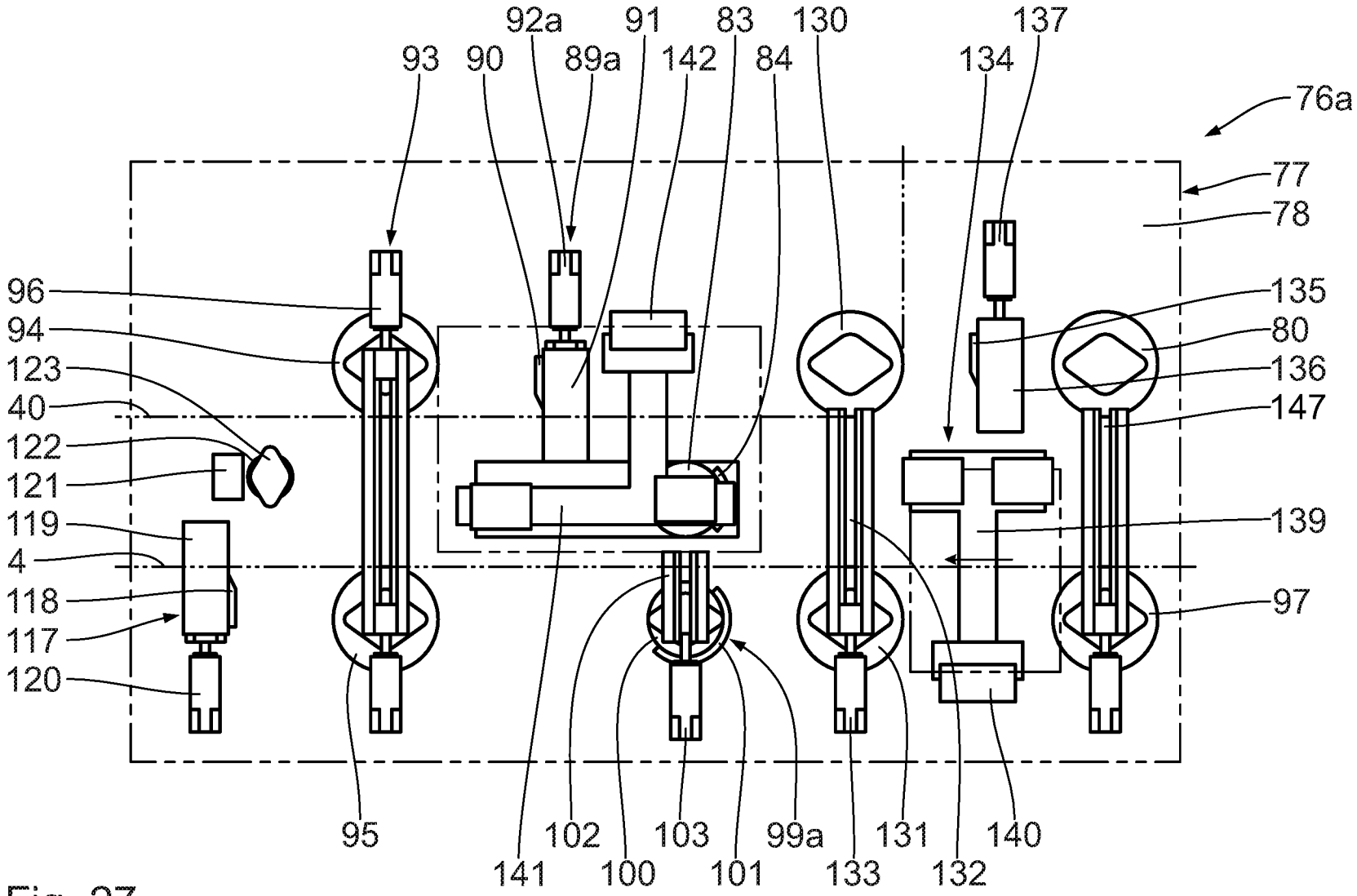
Figure 28:
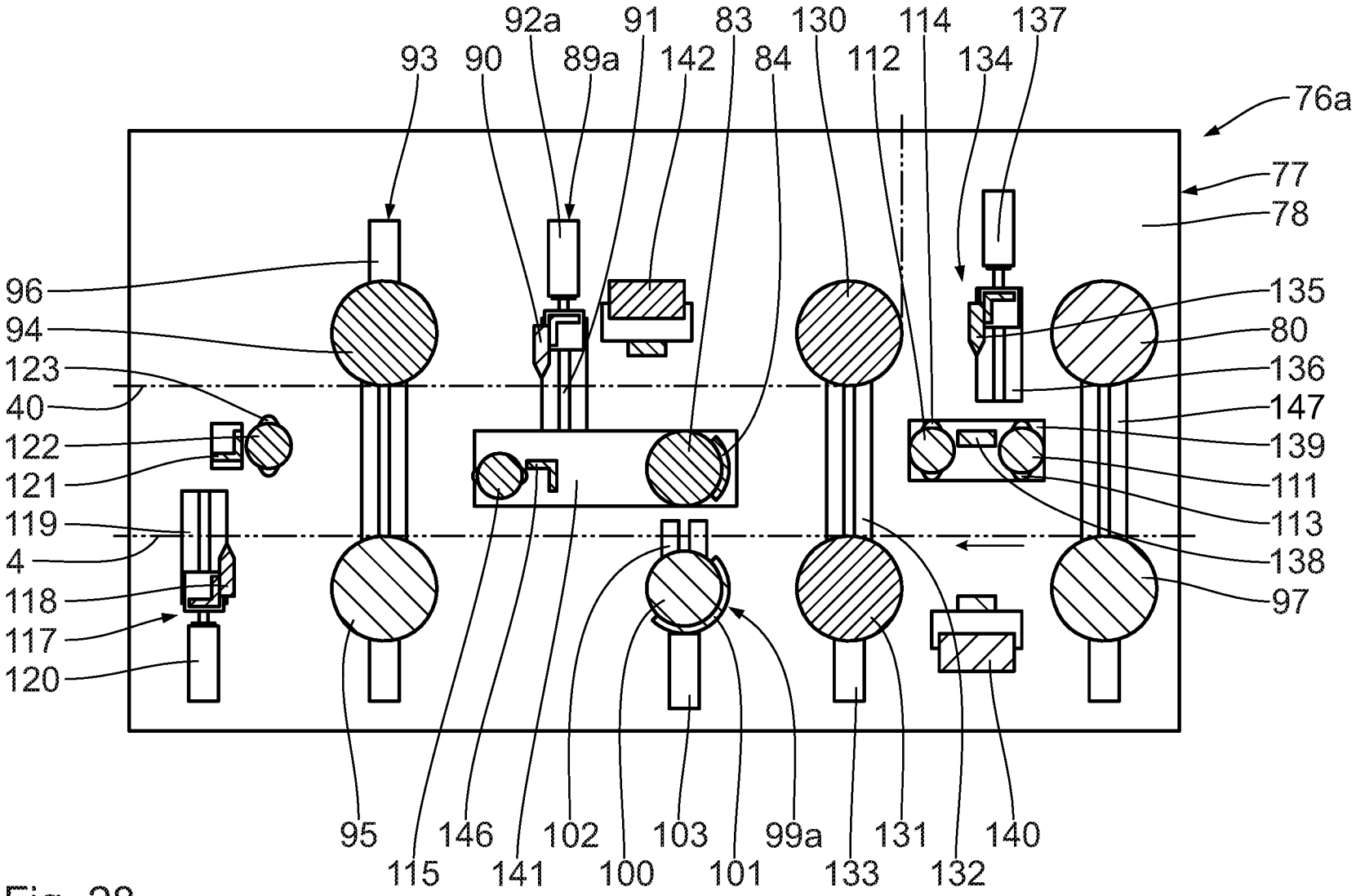

As is shown in FIG. 26, the printed web pilot roller 97 and the lower deflection roller 131 are subsequently displaced upward. The continuous printed web 4 by means of the printed web pilot roller 97 is adhesively bonded to the wound web 129 by way of the second adhesive tape 144. The lamination web pilot roller 80 acts as a counter-roller. The continuous lamination web 40 by means of the lower deflection roller 131 is connected to the lamination web of the corrugated cardboard production assembly 1 by way of the third adhesive tape 145. The upper deflection roller 130 acts as a counter-roller.

The originally continuous printed web 4 is separated by means of the printed web separating device 134. The printed web separating element 135 is displaced downward and interacts with the printed web counter-separating element 138.

The invention claimed is:

1. A corrugated cardboard plant for producing corrugated cardboard, the corrugated cardboard plant comprising:

a corrugated cardboard production assembly comprising:

at least one device for producing at least one corrugated cardboard web which is laminated on one side; and a connecting device for generating a corrugated cardboard web which is laminated on both sides and which comprises the at least one corrugated cardboard web which is laminated on one side;

a printed web/lamination web production assembly comprising:

a printing device for printing a printed web which can be used as a lamination web;

a printed web storage device for storing the printed web; and a lamination web unwinding device for unwinding a cover web which can be used as the lamination web; and a coupling/uncoupling assembly comprising:

a coupling device for coupling the printing device to the corrugated cardboard production assembly while using the printed web as the lamination web in the corrugated cardboard production assembly; and an uncoupling device for uncoupling the printing device from the corrugated cardboard production assembly while using the cover web as the lamination web which is unwound from the lamination web unwinding device in the corrugated cardboard production assembly, the coupling/uncoupling assembly being disposed between the printing device and the printed web storage device.

2. The corrugated cardboard plant as claimed in claim 1, wherein the coupling/uncoupling assembly operates at least partially automatedly.

3. The corrugated plant as claimed in claim 1, wherein the coupling device in case of at least one transported printed web and lamination web is capable of coupling the printing device to the corrugated cardboard production assembly while using the printed web as the lamination web in the corrugated cardboard production assembly.

4. The corrugated plant as claimed in claim 1, wherein the uncoupling device in case of at least one of the group comprising transported printed web and lamination web is capable of uncoupling the printing device from the corrugated cardboard production assembly while using the lamination web in the corrugated cardboard production assembly.

5. The corrugated cardboard plant as claimed in claim 1, wherein the coupling/uncoupling assembly is disposed between the lamination web unwinding device and the connecting device.

6. The corrugated cardboard plant as claimed in claim 1, wherein the coupling/uncoupling assembly comprises at least one of the group comprising a lamination web guide for guiding the lamination web and a printed web guide for guiding the printed web, wherein the printed web guide is separate from said lamination web guide.

7. The corrugated plant as claimed in claim 6, wherein the printed web and the lamination web are guidable mutually separately in the printed web guide and the lamination web guide.

8. The corrugated plant as claimed in claim 1, wherein the coupling/uncoupling assembly comprises at least one activatable lamination web printed web converging installation for in regions converging the lamination web and the printed web.

9. The corrugated cardboard plant as claimed in claim 8, wherein the at least one lamination web printed web converging installation comprises at least one pair of converging elements which for in regions converging the lamination web and the printed web are displaceable relative to one another while forming a convergence gap.

10. The corrugated cardboard plant as claimed in claim 1, wherein the coupling/uncoupling assembly comprises at least one adhesive tape application device for applying at least one adhesive tape to at least one of the group comprising the printed web and the lamination web for fixedly connecting the printed web and the lamination web to one another, said adhesive tape application device being assigned to at least one of the group comprising the printed web and the lamination web.

11. The corrugated plant as claimed in claim 1, wherein the coupling/uncoupling assembly comprises at least one activatable lamination web printed web converging installation for, in regions, converging the lamination web and the printed web, wherein the coupling/uncoupling assembly comprises at least one adhesive tape application device for applying at least one adhesive tape to at least one of the group comprising the printed web and the lamination web for fixedly connecting the printed web and the lamination web to one another, said adhesive tape application device being assigned to at least one of the group comprising the printed web and the lamination web, wherein a control device activates the at least one of the group comprising the at least one lamination web printed web converging installation and the at least one adhesive tape application device in such a manner that converging of the printed web and the lamination web takes place in a region of the at least one adhesive tape which is applied to at least one of the group comprising the printed web and the lamination web, while connecting the printed web and the lamination web to one another by means of the at least one adhesive tape.

12. The corrugated plant as claimed in claim 1, wherein the coupling device comprises at least one lamination web separating device for separating the lamination web.

13. The corrugated plant as claimed in claim 1, wherein the coupling device comprises at least one printed web separating device for separating the printed web.

14. The corrugated plant as claimed in claim 1, wherein the coupling/uncoupling assembly comprises at least one removable counter-drive unit for interacting with at least one of the group comprising at least one separating element while forming a separating device, and with at least one adhesive tape element while forming an adhesive tape application device.

15. The corrugated cardboard plant as claimed in claim 1, wherein the coupling/uncoupling assembly operates completely automatedly, wherein the printed web/lamination web production assembly comprises a printed web splicing device for unwinding the printed web.

16. The corrugated cardboard plant as claimed in claim 1, wherein the at least one lamination web separating device in conveying direction of the lamination web is disposed upstream of a lamination web printed web converging installation.

17. The corrugated cardboard plant as claimed in claim 1, wherein the at least one lamination web separating device in conveying direction of the lamination web is disposed downstream of an adhesive tape application device.

18. The corrugated cardboard plant as claimed in claim 1, wherein a printed web separating device in conveying direction of the printed web is disposed downstream of a lamination web printed web converging installation.

19. The corrugated cardboard plant as claimed in claim 1, wherein at least one printed web separating device in conveying direction of the printed web is disposed downstream of an adhesive tape application device.

20. The corrugated cardboard plant as claimed in claim 1, wherein the printed web/lamination web production assembly comprises a printed web splicing device for unwinding the printed web.

21. A method for producing corrugated cardboard, the method comprising the following steps:

producing corrugated cardboard in a corrugated cardboard production assembly which comprises:

at least one device for producing at least one corrugated cardboard web which is laminated on one side; and a connecting device for generating a corrugated cardboard web which is laminated on both sides and which comprises the at least one corrugated cardboard web which is laminated on one side;

producing at least one of the group comprising a printed web and a lamination web in a printed web/lamination web production assembly which comprises:

a printing device for printing the printed web which can be used as the lamination web;

a printed web storage device for storing the printed web; and a lamination web unwinding device for unwinding a cover web which can be used as the lamination web;

providing a coupling/uncoupling assembly disposed between the printing device and the printed web storage device;

coupling the printing device to the corrugated cardboard production assembly while using the printed web as the lamination web in the corrugated cardboard production assembly; and uncoupling the printing device from the corrugated cardboard production assembly while using the cover web as the lamination web which is unwound from the lamination web unwinding device in the corrugated cardboard production assembly.

22. The method as claimed in claim 21, wherein the printing device is coupled to the corrugated cardboard production assembly while at least one of the group comprising the printing device and the corrugated cardboard production assembly are/is running.

23. The method as claimed in claim 21, wherein the coupling/uncoupling assembly comprises a coupling device and an uncoupling device, the printing device being coupled to the corrugated cardboard production assembly via the coupling device while using the printed web as the lamination web in the corrugated cardboard production assembly, the printing device being uncoupled from the corrugated cardboard production assembly via the uncoupling device while using the cover web as the lamination web in the corrugated cardboard production assembly, wherein the printing device is uncoupled from the corrugated cardboard production assembly while at least one of the group comprising the printing device and the corrugated cardboard production assembly are/is running.

* * * * *